US009140108B2

(12) United States Patent
Shirzadi et al.

(10) Patent No.: US 9,140,108 B2
(45) Date of Patent: Sep. 22, 2015

(54) STATISTICAL RESERVOIR MODEL BASED ON DETECTED FLOW EVENTS

(75) Inventors: Shahryar G. Shirzadi, Katy, TX (US); Richard Bailey, Ashtead (GB); Eric Ziegel, Houston, TX (US)

(73) Assignee: BP Corporation North America Inc., Houston, TX (US)

( * ) Notice: Subject to any disclaimer, the term of this patent is extended or adjusted under 35 U.S.C. 154(b) by 703 days.

(21) Appl. No.: 13/288,840

(22) Filed: Nov. 3, 2011

(65) Prior Publication Data

US 2013/0116998 A1 May 9, 2013

(51) Int. Cl.
*G06G 7/48* (2006.01)
*E21B 43/20* (2006.01)

(52) U.S. Cl.
CPC ..... *E21B 43/20* (2013.01)

(58) Field of Classification Search
None
See application file for complete search history.

(56) References Cited

U.S. PATENT DOCUMENTS

| | | | | |
|---|---|---|---|---|
| 6,519,531 | B1 | 2/2003 | Batycky et al. | |
| 7,289,942 | B2 * | 10/2007 | Yang et al. | 703/10 |
| 7,890,200 | B2 | 2/2011 | Al-Attar et al. | |
| 2006/0224369 | A1 * | 10/2006 | Yang et al. | 703/10 |
| 2008/0234939 | A1 | 9/2008 | Foot et al. | |

OTHER PUBLICATIONS

Sayarpour et al., The use of caacitance-resistance models for rapid estimation of waterflood performance and optimization, 2009, Elsevier, pp. 227-238.*

Liang et al., "Optimization of Oil Production Based on a Capacitance Model of Production and Injection Rates", SPE 107713, presented at the 2007 SPE Hydrocarbon Economics and Evaluation Symposium (2007), pp. 1 to 11.

Sayarpour et al., "The Use of Capacitance-Resistive Models for Rapid Estimation of Waterflood Performance and Optimization", SPE 110081, presented at the 2007 SPE Annual Technical Conference and Exhibition (2007), pp. 1 to 13.

Kaviani et al., "Estimation of Interwell Connectivity in the Case of Fluctuating Bottonnhole Pressures", SPE 117856, presented at the 2008 Abu Dhabi International Exhibition and Conference (2008), pp. 1 to 16.

PCT/US2011/061321 International Search Report and Written Opinion Dated Jul. 19, 2013 (18 p.).

(Continued)

*Primary Examiner* — Omar Fernandez Rivas
*Assistant Examiner* — Bernard E Cothran
(74) *Attorney, Agent, or Firm* — John Poliak

(57) ABSTRACT

Computerized method and system for deriving a statistical reservoir model of associations between injecting wells and producing wells. Potential injector events are interactively identified from time series measurement data of flow rates at the wells, with confirmation that some response to those injector events appears at producing wells. Gradient analysis is applied to cumulative production time series of the producing wells, to identify points in time at which the gradient of cumulative production changes by more than a threshold value. The identified potential producer events are spread in time and again thresholded. An automated association program rank orders injector-producer associations according to strength of the association. A capacitance-resistivity reservoir model is evaluated, using the flow rate measurement data, for the highest-ranked injector-producer associations. Additional associations are added to subsequent iterations of the reservoir model, until improvement in the uncertainty in the evaluated model parameters is not statistically significant.

39 Claims, 22 Drawing Sheets

(56) References Cited

OTHER PUBLICATIONS

Weber, Daniel, et al., "Improvements in Capacitance-Resistance Modeling and Optimization of Large Scale Reservoirs," SPE 121299, 2009 SPE Western Regional Meeting, San Jose, California, Mar. 24-26, 2009 (14 p.).

Delshad, M., et al., "The Use of Capacitance-Resistive Model for Estimation of Fracture Distribution in the Hydrocarbon Reservoir," SPE 126076, 2009 SPE Saudi Arabia Section Technical Symposium and Exhibition, Alkhobar, Saudi Arabia, May 9-11, 2009 (8 p.).

Lee, H., et al., "Identifying Injector-Producer Relationships in Waterflood Using Hybrid Constrained Nonlinear Optimization," SPE 132359, SPE Western Regional Meeting, Anaheim, California, May 27-29, 2010 (12 p.).

Yousef, Ali A., et al., "A Capacitance Model to Infer Interwell Connectivity from Production-and-Injection Rate Fluctuations," SPE 95322, 2005 SPE Annual Technical Conference and Exhibition, Dallas, Texas, Oct. 9-12, 2005, Dec. 2006 SPE Reservoir Evaluation & Engineering (pp. 630-646) (17 p.).

Alhuthali, Ahmed H., et al., "Optimal Rate Control Under Geologic Uncertainty," SPE 113628, 2008 SPE/DOE Improved Oil Recovery Symposium, Tulsa, Oklahoma, Apr. 19-23, 2008 (25 p.).

* cited by examiner

FIG. 14a

| INJECTOR | PRODUCER | CONFIDENCE | SUPPORT | |
|---|---|---|---|---|
| i01_inj_ON | P01_prod_DECREASE | 0.80 | 0.20 | STRONG |
| i05_inj_ON | P04_prod_DECREASE | 0.71 | 0.12 | |
| i03_inj_ON | P04_prod_DECREASE | 0.58 | 0.11 | |
| i03_inj_ON | P01_prod_DECREASE | 0.53 | 0.10 | |
| i05_inj_ON | P01_prod_DECREASE | 0.47 | 0.08 | MEDIUM |
| i02_inj_ON | P01_prod_DECREASE | 0.45 | 0.05 | |
| i04_inj_ON | P01_prod_DECREASE | 0.39 | 0.09 | |
| i02_inj_ON | P03_prod_DECREASE | 0.36 | 0.04 | |
| i04_inj_ON | P04_prod_DECREASE | 0.30 | 0.07 | |
| i01_inj_ON | P04_prod_DECREASE | 0.28 | 0.07 | WEAK |
| i05_inj_ON | P03_prod_DECREASE | 0.18 | 0.03 | |
| i04_inj_ON | P02_prod_DECREASE | 0.17 | 0.04 | |
| i01_inj_ON | P02_prod_DECREASE | 0.16 | 0.04 | |

FIG. 14b

| INJECTOR | CON1 | CONFIDENCE | SUPPORT | |
|---|---|---|---|---|
| i01_inj_OFF | P01_prod_DECREASE | 1.00 | 0.20 | STRONG |
| i03_inj_OFF | P04_prod_DECREASE | 0.71 | 0.10 | |
| i05_inj_OFF | P04_prod_DECREASE | 0.67 | 0.12 | |
| i04_inj_OFF | P04_prod_DECREASE | 0.57 | 0.12 | |
| i05_inj_OFF | P01_prod_DECREASE | 0.50 | 0.09 | |
| i01_inj_OFF | P04_prod_DECREASE | 0.45 | 0.09 | MEDIUM |
| i04_inj_OFF | P01_prod_DECREASE | 0.38 | 0.08 | |
| i03_inj_OFF | P01_prod_DECREASE | 0.36 | 0.05 | |
| i02_inj_OFF | P01_prod_DECREASE | 0.33 | 0.06 | |
| i03_inj_OFF | P02_prod_DECREASE | 0.21 | 0.03 | WEAK |
| i01_inj_OFF | P02_prod_DECREASE | 0.20 | 0.04 | |
| i02_inj_OFF | P03_prod_DECREASE | 0.17 | 0.03 | |
| i02_inj_OFF | P04_prod_DECREASE | 0.17 | 0.03 | |
| i05_inj_OFF | P03_prod_DECREASE | 0.17 | 0.03 | |
| i01_inj_OFF | P03_prod_DECREASE | 0.15 | 0.03 | |

STATISTICAL RESERVOIR MODEL BASED ON DETECTED FLOW EVENTS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention is in the field of oil and gas production. Embodiments of this invention are more specifically directed to the analysis of secondary recovery actions in maximizing oil and gas output.

The current economic climate emphasizes the need for optimizing hydrocarbon production. Such optimization is especially important considering that the costs of drilling new wells and operating existing wells are high by historical standards, largely because of the extreme depths to which new producing wells must be drilled and because of other physical barriers to discovering and exploiting reservoirs; those reservoirs that are easy to reach have already been developed and produced. These high economic stakes require operators to devote substantial resources toward effective management of oil and gas reservoirs, and effective management of individual wells within production fields.

As known in the art, an important secondary recovery operation injects water, gas, or other fluids into the reservoir at one or more injection wells, commonly referred to as "waterflood". In theory, this injection increases the pressure in producing wells that are connected to the injection wells via the reservoir, thus producing oil and gas at increased flow rates. In planning and managing secondary recovery operations, the operator is faced with decisions regarding whether to initiate or cease such operations, and also how many wells are to serve as injection wells and their locations in the field, to maximize production at minimum cost.

As known in the art, the optimization of a production field is a complex problem, involving many variables and presenting many choices, exacerbated by the complexity and inscrutability of the sub-surface "architecture" of today's producing reservoirs. Especially for those reservoirs at extreme depths, or located in difficult or inaccessible land or offshore locations, the precision and accuracy of the necessarily indirect methods used to characterize the structure and location of the hydrocarbon-bearing reservoirs is necessarily limited. In addition, the sub-surface structure of many reservoirs presents complexities such as variable porosity and permeability of the rock; fractures and faults that compartmentalize formations may also be present in the reservoir, further complicating sub-surface fluid flow. Models and numerical techniques for estimating and analyzing the effect of injection at one well, on the flow rates at one or more producing wells, are desirable tools toward solving this complex problem of production optimization.

One class of models for analyzing the effects of waterflood injection are known in the art as "capacitance models", or "capacitance-resistivity models". Examples of these models are described in Liang et al., "Optimization of Oil Production Based on a Capacitance Model of Production and Injection Rates", SPE 107713, presented at the 2007 SPE Hydrocarbon Economics and Evaluation Symposium (2007); Sayarpour et al., "The Use of Capacitance-resistivity Models for Rapid Estimation of Waterflood Performance and Optimization", SPE 110081, presented at the 2007 SPE Annual Technical Conference and Exhibition (2007); and Kaviani et al., "Estimation of Interwell Connectivity in the Case of Fluctuating Bottomhole Pressures", SPE 117856, presented at the 2008 Abu Dhabi International Exhibition and Conference (2008). In a general sense, the capacitance-resistivity model ("CRM") is the result of a regression (e.g., multivariate linear regression) applied to injector well flow rates and producing well flow rates, to express the cumulative production rate at a producing well over time as the sum of a primary production term (typically an exponential from an initial production rate value), a term expressing the effect of changes in the bottomhole pressure (BHP) at the producing well itself, and a third term corresponding to the flow rate at an injector multiplied by an interwell connectivity coefficient for the path between the injector and the producing well of interest, summed over all relevant injectors in the field. Such a model enables evaluation of changes in the output at a producing well, in response to changes in injection rate at one or more injectors.

Of course, modern production fields generally involve more than one producing well, each responding to injection at one or more injector wells. In other words, the flow from a given injector will be non-uniformly distributed by the formation to the various producing wells; in addition, producer-producer effects can also be present, in which increased production at one producing well affects the production at another producing well (e.g., by locally reducing reservoir pressure at the affected well). These mechanisms prohibit CRM evaluation at each well individually—rather, the definition and evaluation of the model requires the regression to be simultaneously performed over all producing wells relative to all injecting wells. Considering that conventional capacitance-resistivity models use three parameters for each injector-producer well combination, even a modestly-sized field will necessitate convergence of the model over a relatively large number of parameters. As a result, the CRM is necessarily over-parameterized, often resulting in the inability to reach a reasonable solution when applied to realistic production fields. Even with modern computational resources, this operation is, at best, quite time-consuming and inefficient.

For mature production fields, well flow rates over time provide a significant source of data useful in deriving a connectivity model. In some cases, flow rates over time for both producing and injecting wells are directly available; in other cases, downhole or wellhead pressure and temperature measurements are available, from which flow rates may be inferred. Again, for even a modestly-sized production field, the amount of these data can rapidly become overwhelming. Rigorous numerical analysis of these data in defining and evaluating a connectivity or response model (e.g., CRM) consumes substantial computing time and resources. These large data sets and the complex interaction of the flows among the injectors and producers render it difficult for a human user or for an automated numerical system to identify causal relationships between injection events and produced fluids.

By way of further background, U.S. Pat. No. 7,890,200, issued Feb. 15, 2011, entitled "Process-Related Systems and Methods", commonly assigned herewith and incorporated herein by reference in its entirety, describes a system and method for monitoring values of multiple process variables over time, and identifying causal relationships among the process variables, including identification of cause events in one process variable and corresponding response events in another process variable. According to this patent, the system and method also associate confidence levels for the identified events.

BRIEF SUMMARY OF THE INVENTION

According to various embodiments, present teachings provide a method and automated system that can efficiently derive a statistical model for injector-producer behavior in an oil and gas field from historical production data.

According to various embodiments, present teachings provide a readily scalable method and system capable of efficiently analyzing a large number of events over long periods of time, in a "hands-off" manner from the viewpoint of reservoir engineering personnel.

According to various embodiments, present teachings provide such a method and system that provides statistical insight into model parameters, as may be useful in the optimization of production from the field.

According to various embodiments, present teachings provide such a method and system that can readily identify correlated causal events in the production data in an automated manner.

According to various embodiments, present teachings provide such a method and system that can facilitate user input and selection in the identification of causal events and relationships in the production data.

According to various embodiments, present teachings provide such a method and system operable on flow measurements over time and also on proxies for flow rates.

According to various embodiments, present teachings provide such a method and system that can filter intra-well events, such as changes in gas lift or choke position, from the detection of causal events in the production data.

According to various embodiments, present teachings provide such a method and system that can identify injection response events that may be masked by an intra-well event at the producing well.

According to various embodiments, present teachings provide such a method and system that can account for correlation of simultaneously-occurring injection events at multiple injector wells.

According to various embodiments, present teachings provide such a method and system that can evaluate the economic benefit of injection at particular wells.

According to various embodiments, present teachings provide such a method and system that can utilize unstructured data in the derivation and evaluation of the statistical model.

Other objects and advantages of exemplary embodiments herein will be apparent to those of ordinary skill in the art having reference to the following specification together with its drawings.

This invention provides a computer system and method of evaluating the effect of potential waterflood secondary recovery actions to be applied to an oil and gas reservoir at which several producing wells and several injecting wells are in place. Measurement data, such as well flow rates and bottom-hole pressures, are acquired over time. These measurement data are analyzed to identify cause-and-effect associations among the injectors and producers. The associations are rank-ordered according to confidence values, for example into subsets of strong association, moderate association, weak association, and no association. The injector-producer interconnections corresponding to the highest-ranked associations are applied to a capacitance-resistivity reservoir model. The capacitance-resistivity model is evaluated relative to the measurement data, to obtain some measure of the error. One or more of the next-highest rank-ordered interconnections are applied to the model, which is again evaluated relative to the measurement data. Additional associations are applied to the model, and the evaluation repeated, until the incremental change in fit to the measurement data resulting from an added interconnection has no statistical significance. Other exclusion principals, for example based on geography or geology, may also be applied. The resulting model at convergence is then used to optimize waterflood and production.

The exemplary system and method provides rapid turnaround in evaluation of potential waterflood actions. By iteratively applying interconnections in order of their confidence levels from the identification process, the number of interconnections applied to the capacitance-resistivity model is limited to only those necessary to fit the measurement data. Interconnections that have little or no effect are not involved in the construction and evaluation of the reservoir model. This results in a lean and efficient reservoir model that can rapidly evaluate candidate secondary recovery actions. The system and method are also readily scalable to production fields including a large number of injecting and producing wells, and to historical flow data obtained over relatively long periods of time.

The exemplary system and method is capable of standard error and confidence calculations in the capacitance-resistivity model, by iteratively eliminating parameters with high standard error and thus increasing the confidence around the remaining parameters. As a result, the system and method can reach a higher degree of confidence in its analysis.

The exemplary system and method is capable of estimating the average response time for the production field via reservoir-level capacitance-resistivity modeling, and enables linking of those estimates to causal-response analysis to better estimate injector-producer associations.

The exemplary system and method is capable of estimating the value of water (i.e., the volume of oil produced relative to the volume of water injected at each injector), for prioritizing injection among the injectors in the production field in optimizing waterflood performance.

BRIEF DESCRIPTION OF THE SEVERAL VIEWS OF THE DRAWING

FIGS. 14*a* and 14*b* illustrate examples of rank-ordered lists of injector-producer associations, as resulting from the method of FIG. 12 according to that embodiment.

DETAILED DESCRIPTION OF THE INVENTION

This invention will be described in connection with one or more of its embodiments. More specifically, this description refers to embodiments of this invention that are implemented into a computer system programmed to carry out various method steps and processes for optimizing production via secondary recovery actions, specifically waterflood injection, because it is contemplated that this invention is especially beneficial when used in such an application. However, it is also contemplated that this invention can be beneficially applied to other systems and processes. Accordingly, it is to be understood that the following description is provided by way of example only, and is not intended to limit the true scope of this invention as claimed.

Figure 1A:
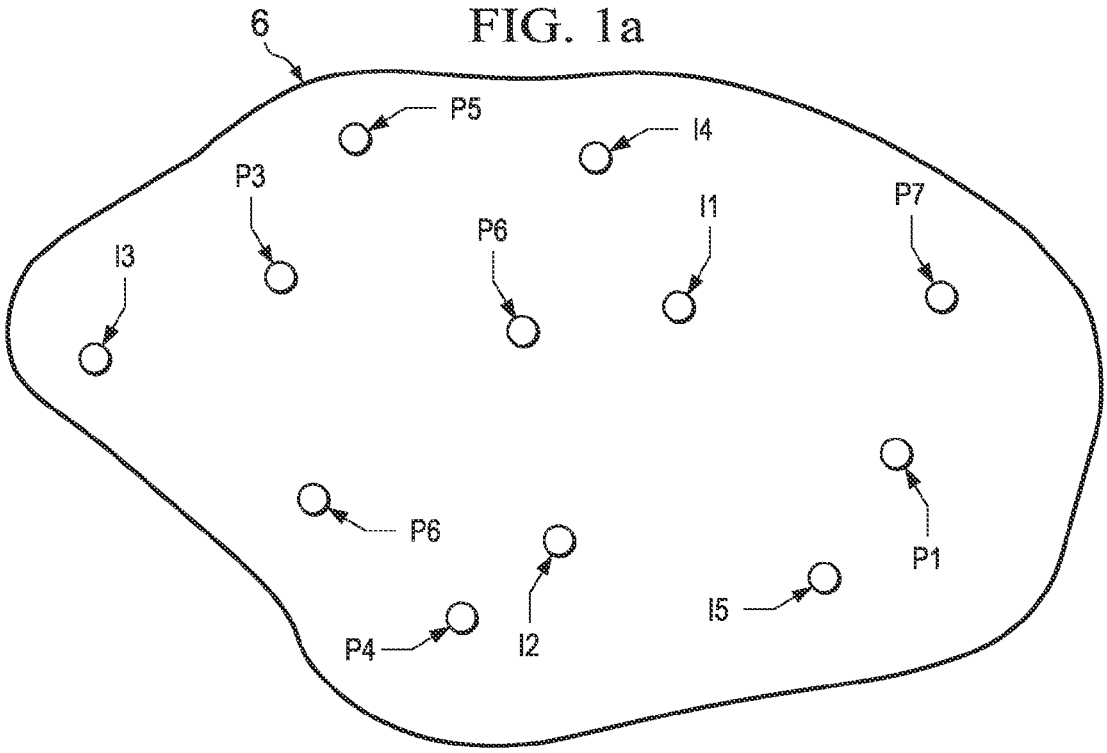
FIG. 1*a* is a schematic representation of an oil and gas production field to which exemplary embodiments herein can be applied.

For purposes of providing context for this description, FIG. 1*a* illustrates, in plan view, an example of a small production field in connection with which embodiments of this invention may be utilized. In this example, multiple wells P1 through P7 and I1 through I5 are deployed at various locations within production field 6, and in the conventional manner extend into the earth through one or more sub-surface strata. Typically, each of wells P1 through P7 and I1 through I5 is in communication with one or more producing formations by way of perforations, in the conventional manner. In this example, wells P1 through P7 are producing wells ("producers"), such that hydrocarbons from one or more sub-surface formations flow out from those wells. Conversely, in this example, wells I1 through I5 are injecting wells ("injectors"), via which gas, water, or other fluids are pumped into the formations to increase production from producing wells P1 through P7.

As known in the art, modern oil and gas wells are deployed with various sensors by way of which various operational parameters can be measured or otherwise deduced. From the standpoint of inflow and outflow, the most direct measurement of flow rates is accomplished by a flow meter deployed at each well P1 through P7 and I1 through I5. In those production fields in which the flow from multiple producing wells is commingled at a manifold, a flow meter may be deployed at the manifold and measure the combined flow from those wells; the flow rate from the individual wells is then typically deduced by other means, such as flow tests. Many modern wells are deployed with downhole pressure and temperature sensors, wellhead pressure and temperature sensors, or some combination of both. Modern computational techniques, for example based on predictive well models, can be used to derive flow rates from these measurements of pressure and temperature. U.S. Patent Application Publication No. 2008/0234939, published Sep. 25, 2008, entitled "Determining Fluid Rate and Phase Information for a Hydrocarbon Well Using Predictive Models", commonly assigned herewith and incorporated herein by reference, in its entirety, describes systems and methods for deriving flow rates from pressure and temperature measurements at the well, as may be used in connection with embodiments of this invention. Other measurements that can be obtained from modern oil and gas wells include measurement of such parameters as temperature, pressure, valve settings, gas-oil ratio, and the like. Measurements other than well measurements can also be acquired, examples of which include process measurements taken at the surface, results from laboratory analysis of production samples, and also estimates from various computational models based on measured parameters. These measurements and estimates can be useful in analysis of the measured or deduced flow rates, or can be otherwise useful in the management of the production field.

Even for relatively simple production field 6 as shown in FIG. 1*a*, the sub-surface connectivity among wells P1 through P7 and I1 through I5 can be quite complex, insofar as the behavior of actual flowing oil, gas, and water is concerned. The porosity and permeability of the rock can vary at different sub-surface locations of the earth in the vicinity of the production field. In addition, geological structures such as faults, passages, barriers, and preferential orientation of fluid-permeable paths, can complicate the sub-surface fluid flow. The understanding of fluid movement within a producing hydrocarbon reservoir can therefore become quite complicated, even in the presence of relatively few features in a relatively small domain.

As mentioned above and as well known in the art, secondary recovery techniques are useful in maximizing the production of oil and gas from typical reservoirs. In the context of embodiments of this invention, the secondary recovery efforts that are of interest involve the injection of gas, water, or other fluids at injection wells, such as injectors I1 through I5 of production field 6 of FIG. 1*a*. As known in the art, because of cost considerations and also because of the possibility of unintended consequences on the reservoir, such waterflood injection is generally not constant over time, but is applied to one or more injection wells at particular times, for specific durations. Often, injection is applied simultaneously to more than one injection well in the field, but not necessarily to all available injection wells.

As discussed above, however, the relationship between injection at a given injection well and the resulting increase in production at a producing well, is not straightforward, as it depends on the complex architecture and connectivity of the sub-surface formations and interfaces. In addition to simply considering overall flow rates, the flow rates of different fluid phases (i.e., oil, gas, water) must be considered. For example, sub-surface "short-circuiting" can occur, in which injected water disproportionately flows to a nearby producing well, causing an increase in water flow from that nearby well with little effect on oil production. These and other complexities complicate the design and optimization of secondary recovery by way of injection.

As mentioned above, the measurement capability deployed in modern production fields provides good intelligence over time regarding the flow rates over time from each of the wells in the production field. These measurements provide a significant source of measurement data useful in designing, evaluating, and optimizing secondary recovery efforts. However, the complexities of the production field noted above, along with the somewhat unknown response of the formations to the injection efforts, render it difficult to readily identify the optimum injection stimulus for maximizing the hydrocarbon output response.

Figure 1B:
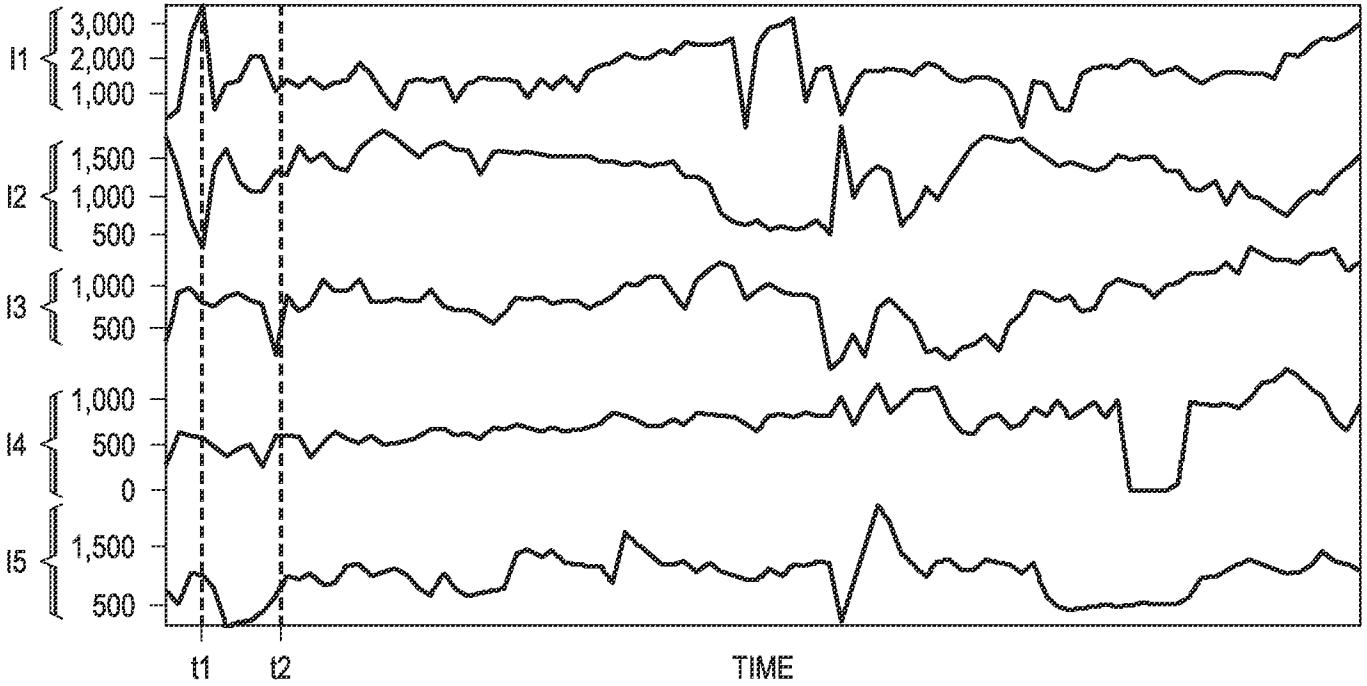
FIGS. 1*b* and 1*c* are examples of time series representations of injection and production flow, respectively, corresponding to wells in the production field of FIG. 1*a*.

FIG. 1*b* illustrates an example of typical time series of injection flow rates, such as may be measured at injection wells I1 through I5 of production field 6 of FIG. 1*a*. As evident from this FIG. 1*b*, the injection flow rates at injection wells I1 through I5 differ over time from one another, but at certain times may correlate with one another. For example, at time t1 in FIG. 1*b*, the injection flow rate at injection well I1 sharply drops while the injection flow rate at injector I2 sharply increases. Beginning at time t2 of FIG. 1*b*, the injection flow rates at injectors I1, I4, I5 begin to slowly increase over time. Other correlated and non-correlated changes in injection flow rates are present over the time period illustrated in FIG. 1, which may extend over a relatively long period of time (e.g., over "epochs" measured in years).

Figure 1C:
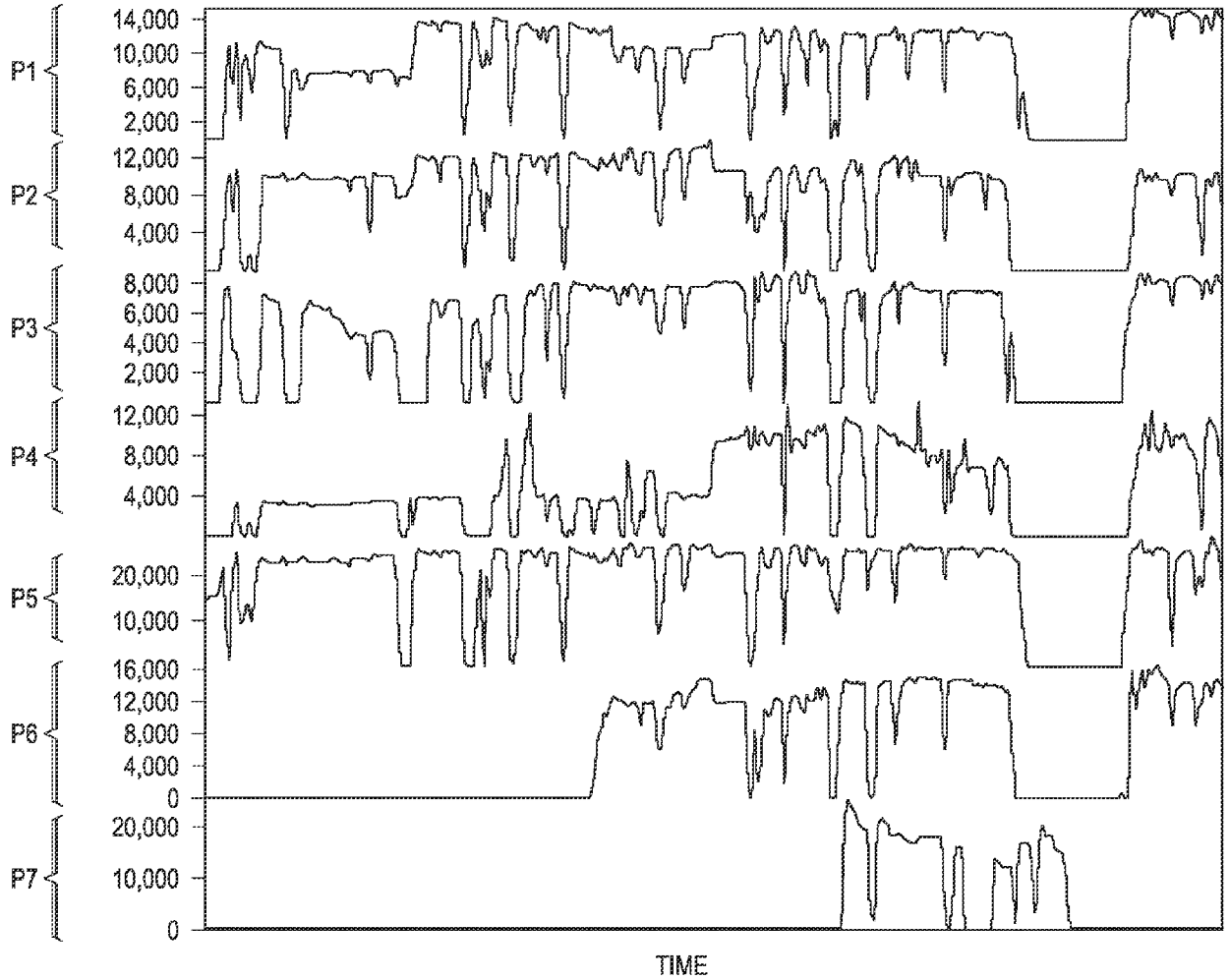

FIG. 1*c* illustrates an example of typical time series of production flow rates, for one or multiple phases, such as may be measured at producing wells P1 through P7 of production field 6 of FIG. 1*a* during a period of time over which secondary recovery efforts, such as the injection shown in FIG. 1*b*, may be applied. These flow rates include the typical decline in production over time, as reservoir pressure falls, but that fundamental effect is generally masked by various actions taken at the wells themselves. For example, as evident in FIG. 1*c*, various "shut-in" events occur throughout the measurement period (which, again, may extend over months or years). Changes in choke valve position at the wellhead of each of producing wells P1 through P7 may also be involved in causing various changes in the production flow rate. As shown in FIG. 1*c*, wells P6 and P7 are shut-in (or, perhaps, did not exist) until later in the illustrated time period. In addition, the secondary recovery action of injection at injectors I1 through I5 is also overlaid onto the production rates and other events, in the time series of FIG. 1*c*.

During the waterflood, other secondary recovery actions may also be performed at the producing wells themselves. One example of such other secondary recovery techniques is "gas lift", in which gas is injected into the annulus between the production tubing and the casing of a producing well, causing aeration of the oil in the producing formation at the well. The resulting reduction in the density of the oil allows the formation pressure to lift the oil column to the surface and increase the production output. Gas lift may be injected continuously or intermittently, depending on the producing characteristics of the well and the arrangement of the gas-lift equipment. The effects of these intra-well stimuli are also reflected in the time series of production flow rates, as shown in FIG. 1*c*.

It should therefore be evident from the above discussion that the tasks of designing, evaluating, and optimizing secondary recovery actions involving waterflood injection, based on the large data base of flow rate measurements or calculations over time, involve complicated and cumbersome analysis.

Computerized System

Figure 2:
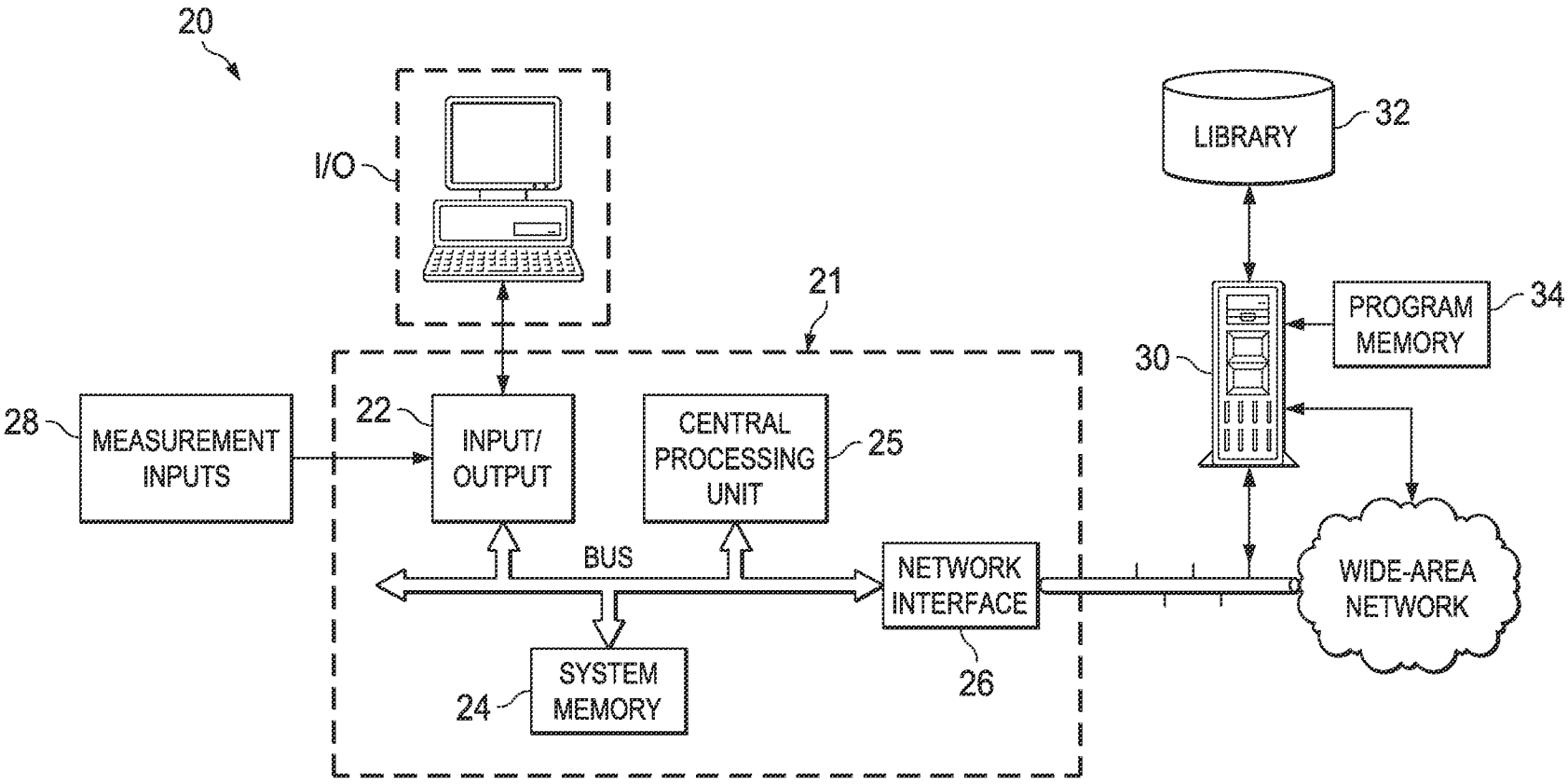
FIG. 2 is an electrical diagram, in block form, of a computer system constructed according to exemplary embodiments herein.

Embodiments of this invention are directed to a computerized method and system for analyzing measurements or calculations of injection and production flow rates to accurately and efficiently design, evaluate, and optimize oil and gas production from one or more wells in a production field by way of waterflood injection. FIG. 2 illustrates, according to an exemplary embodiment, the construction of analysis system ("system") 20, which performs the operations described in this specification to efficiently derive a statistical model of the association between injectors and producers in a production field, based on measurements or calculations of flow rate or other response variables acquired over time from deployed wells. In this example, system 20 can be realized by way of a computer system including workstation 21 connected to server 30 by way of a network. Of course, the particular architecture and construction of a computer system useful in connection with this invention can vary widely. For example, system 20 may be realized by a single physical computer, such as a conventional workstation or personal computer, or alternatively by a computer system implemented in a distributed manner over multiple physical computers. Accordingly, the generalized architecture illustrated in FIG. 2 is provided merely by way of example.

As shown in FIG. 2 and as mentioned above, system 20 includes workstation 21 and server 30. Workstation 21 includes central processing unit 25, coupled to system bus BUS. Also coupled to system bus BUS is input/output interface 22, which refers to those interface resources by way of which peripheral functions I/O (e.g., keyboard, mouse, display, etc.) interface with the other constituents of workstation 21. Central processing unit 25 refers to the data processing capability of workstation 21, and as such may be implemented by one or more CPU cores, co-processing circuitry, and the like. The particular construction and capability of central processing unit 25 is selected according to the application needs of workstation 21, such needs including, at a minimum, the carrying out of the functions described in this specification, and also including such other functions as may be executed by system 20. In the architecture of system 20 according to this example, system memory 24 is coupled to system bus BUS, and provides memory resources of the desired type useful as data memory for storing input data and the results of processing executed by central processing unit 25, as well as program memory for storing the computer instructions to be executed by central processing unit 25 in carrying out those functions. Of course, this memory arrangement is only an example, it being understood that system memory 24 can implement such data memory and program memory in separate physical memory resources, or distributed in whole or in part outside of workstation 21. In addition, as shown in FIG. 2, measurement inputs 28 that are acquired from downhole and surface flow meters, pressure and temperature transducers, valve settings, and the like deployed at both injection wells and production wells in the production field are input via input/output function 22, and stored in a memory resource accessible to workstation 21, either locally or via network interface 26. These measurement inputs 28 can also include process measurements obtained in the processing of the produced output, and results from laboratory analysis of production samples, etc.; in addition, measurement inputs 28 can include estimates from computerized models (whether executed on workstation 21 or elsewhere within system 20) based on measurement inputs 28 themselves or other extrinsic information.

Network interface 26 of workstation 21 is a conventional interface or adapter by way of which workstation 21 accesses network resources on a network. As shown in FIG. 2, the network resources to which workstation 21 has access via network interface 26 includes server 30, which resides on a local area network, or a wide-area network such as an intranet, a virtual private network, or over the Internet, and which is accessible to workstation 21 by way of one of those network arrangements and by corresponding wired or wireless (or both) communication facilities. In this embodiment, server 30 is a computer system, of a conventional architecture similar, in a general sense, to that of workstation 21, and as such includes one or more central processing units, system buses, and memory resources, network interface functions, and the like. According to this embodiment of the invention, server 30 is coupled to program memory 34, which is a computer-readable medium that stores executable computer program instructions, according to which the operations described in this specification are carried out by analysis system 20. In this embodiment of the invention, these computer program instructions are executed by server 30, for example in the form of an interactive application, upon input data communicated from workstation 21, to create output data and results that are communicated to workstation 21 for display or output by peripherals I/O in a form useful to the human user of workstation 21. In addition, library 32 is also available to server 30 (and perhaps workstation 21 over the local area or wide area network), and stores such archival or reference information as may be useful in system 20. Library 32 may reside on another local area network, or alternatively be accessible via the Internet or some other wide area network. It is contemplated that library 32 may also be accessible to other associated computers in the overall network.

Of course, the particular memory resource or location at which the measurements, library 32, and program memory 34 physically reside can be implemented in various locations accessible to system 20. For example, these data and program instructions may be stored in local memory resources within workstation 21, within server 30, or in network-accessible memory resources to these functions. In addition, each of these data and program memory resources can itself be distributed among multiple locations, as known in the art. It is contemplated that those skilled in the art will be readily able to implement the storage and retrieval of the applicable measurements, models, and other information useful in connection with this embodiment of the invention, in a suitable manner for each particular application.

According to this embodiment of the invention, by way of example, system memory 24 and program memory 34 store computer instructions executable by central processing unit 25 and server 30, respectively, to carry out the functions described in this specification, by way of which a computer model of the causal interrelationships among wells in the production field can be generated from actual measurements obtained from the wells, and by way of which that model evaluated and analyzed to ultimately determine the effects of proposed secondary recovery activities on the production output. These computer instructions may be in the form of one or more executable programs, or in the form of source code or higher-level code from which one or more executable programs are derived, assembled, interpreted or compiled. Any one of a number of computer languages or protocols may be used, depending on the manner in which the desired operations are to be carried out. For example, these computer instructions may be written in a conventional high level language, either as a conventional linear computer program or arranged for execution in an object-oriented manner. These instructions may also be embedded within a higher-level application. For example, an executable web-based application can reside at program memory 34, accessible to server 30 and client computer systems such as workstation 21, receive inputs from the client system in the form of a spreadsheet, execute algorithms modules at a web server, and provide output to the client system in some convenient display or printed form. It is contemplated that those skilled in the art having reference to this description will be readily able to realize, without undue experimentation, this embodiment of the invention in a suitable manner for the desired installations. Alternatively, these computer-executable software instructions may be resident elsewhere on the local area network or wide area network, or downloadable from higher-level servers or locations, by way of encoded information on an electromagnetic carrier signal via some network interface or input/output device. The computer-executable software instructions may have originally been stored on a removable or other non-volatile computer-readable storage medium (e.g., a DVD disk, flash memory, or the like), or downloadable as encoded information on an electromagnetic carrier signal, in the form of a software package from which the computer-executable software instructions were installed by system 20 in the conventional manner for software installation.

Operation of the Computerized System

Figure 3:
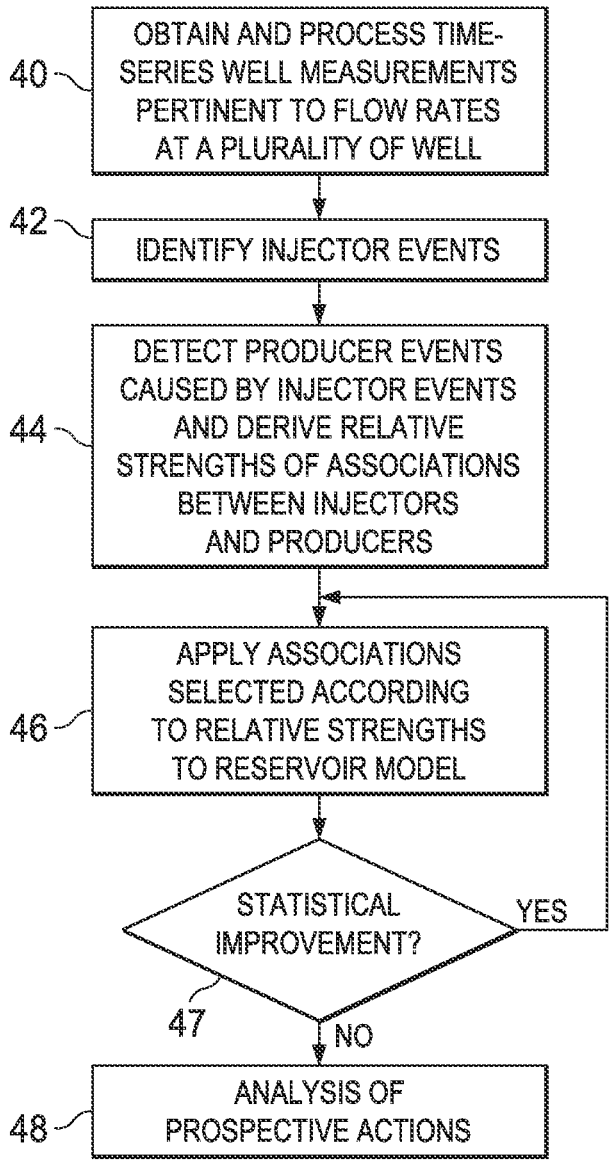
FIG. 3 is a flow diagram illustrating the operation of the computer system of FIG. 2 according to exemplary embodiments herein.

FIG. 3 illustrates the generalized operation of system 20 in carrying out the analytical and statistical functions involved in evaluating the effect of potential waterflood secondary recovery actions, according to embodiments of the invention. As discussed immediately above, it is contemplated that the various steps and functions in this process can be performed by one or more of the computing resources in system 20 executing computer program instructions resident in the available program memory, in conjunction with user inputs as appropriate. While the following description will present an example of this operation as carried out at workstation 21 in the networked arrangement of system 20 shown in FIG. 2, it is of course to be understood that the particular computing component used to perform particular operations can vary widely, depending on the system implementation. As such, the following description is not intended to be limiting, particularly in its identification of those components involved in a particular operation. It is therefore contemplated that those skilled in the art will readily understand, from this specification, the manner in which these operations can be performed by computing resources in these various implementations and realizations. Accordingly, it is contemplated that reference to the performing of certain operations by system 20 will be sufficient to enable those skilled readers to readily implement embodiments of this invention, without undue experimentation.

In the high-level flow diagram of FIG. 3, the process begins with process 40 in which measurement data pertaining to flow rates of wells in production field 6 under investigation are obtained and processed. As shown in the more detailed flow diagram of FIG. 4*a*, process 40 may be performed by first importing these measurement data from the appropriate data source, in process 50. In the example of system 20 shown in FIG. 2, process 50 may be performed by obtaining data values corresponding to measurements directly obtained from flow meters and other sensors in the field via measurement inputs 28, and by retrieving historical measurement data stored in data library 32 and available to workstation 21 via network interface 28 and server 30. These measurement data obtained in process 50 can thus include historical flow rate measurements (including measurements for separate phases of multiphase flows) from each injector I1 through I5 and producer P1 through P7 of production field 6, flow rates for those wells as calculated from indirect measurements at the wells (e.g., from pressure and temperature measurements), as well as other well measurements pertaining to flow rates, such as bottomhole pressure (BHP) over time. It is contemplated that the time duration over which these measurements are obtained may be relatively long, covering months or even years. As known in the art, changes in well count (either or both injectors or producers) in a production field often shifts the relationships among wells in the field, changing the responsiveness of previously-existing and still-existing producers to injection activity; as such, the measurement data acquired in process 50 and analyzed according to embodiments of this invention may be constrained to a particular "epoch" in which the injector and producer well count is constant. Non-structured or non-periodic data, such as data from fluid samples, well tests, and chemistry analysis, may also be incorporated into the particular time series retrieved in process 50. The data obtained in process 50 will be retrieved, or otherwise considered, as a time series of measurements according to embodiments of this invention.

Figure 4A:
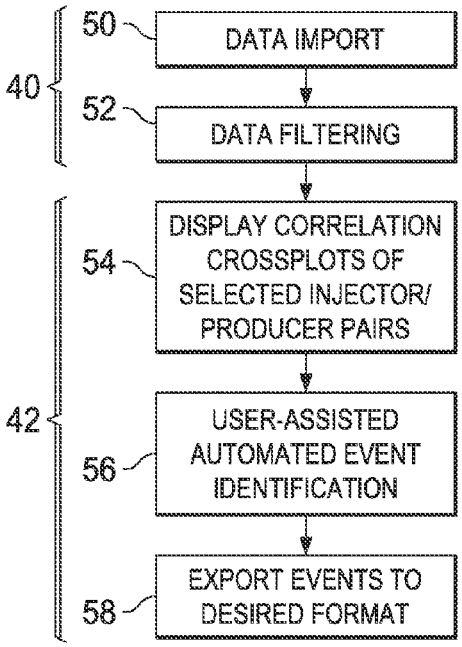
FIGS. 4*a* and 4*b* are flow diagrams illustrating the operation of the system of FIG. 2 in identifying injector events in the operational flow of FIG. 3, according to an exemplary embodiment herein.

Process 40 also includes various filtering and processing of these measurement data, as may be suitable for analysis according to embodiments of this invention, as performed in data filtering process 52 (FIG. 4*a*). According to this embodiment of the invention, process 52 may be executed by the user at workstation 21 interactively selecting certain data streams for consideration, such data streams including one or more measurements (particular flow rates, BHP, etc.) from one or more of injector I1 through I5 and producer P1 through P7 of production field 6. For the selected data streams, system 20 preferably processes the data to remove invalid values from the data streams (e.g., measurements obtained by faulty sensors, values for days in which sensors were disabled, physically impossible measurement values such as negative pressures, etc.), and filters the data to remove statistical outliers. Such invalid values or statistical outliers may be replaced, in data filtering process 52, by interpolated values calculated from surrounding data values in the time series. This statistical filtering may be performed in an interactive manner via workstation 21, with the user selecting the specific statistical criteria for excluding outliers, for example by viewing histograms and time series visualizations of the measurement data as processed. In addition, filtering process 52 preferably adjusts or filters the measurement data into a regular periodic form, for example with one measurement per day; for example, measurements corresponding to partial days may be adjusted to values corresponding to full day output. Corrections to "reservoir barrels" or some other normalization to a single basis for data handling can also be implemented in process 52, for example to compensate for substantial differences in fluid compressibility (e.g., between water and gas in a water-alternative-gas system), and other smaller but influential changes due to salinity treatment (e.g., "LoSal" treatments").

Referring back to FIG. 3, following the obtaining and processing of measurement data in process 40, system 20 next performs process 42, in which injector "events" are identified from the processed measurement data. In a general sense, the injector events identified in process 42 are changes in the flow rate of injected fluid (gas, water, chemicals, or other fluids, or mixtures of the same) at injectors I1 through I5 of production field 6 under investigation, and particularly those changes in injection flow rate that may cause a response in the flow rates at one or more of producers P1 through P7 in that production field 6. Other events, such as the initiation of water-alternative-gas injection at injectors, or changes in an output measurement such as gas production or the gas-oil ratio (GOR) at one or a collection of producers, can also be analyzed in this connection. As will be described in detail below, for those situations in which "inter-well" effects (i.e., action at one well affecting other wells) are of particular interest, certain embodiments of the invention are capable of filtering out "intra-well" effects (e.g., the effect of gas lift or changes in the choke valve settings at a producing well upon the flow rate at that producer) that may mask the inter-well effects sought to be understood.

Figure 4B:
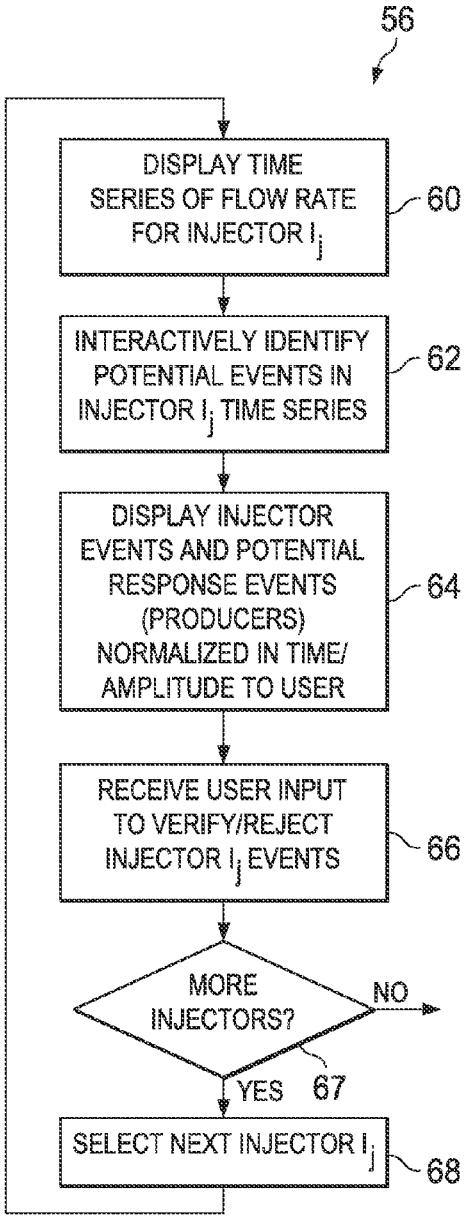
Figure 5A:
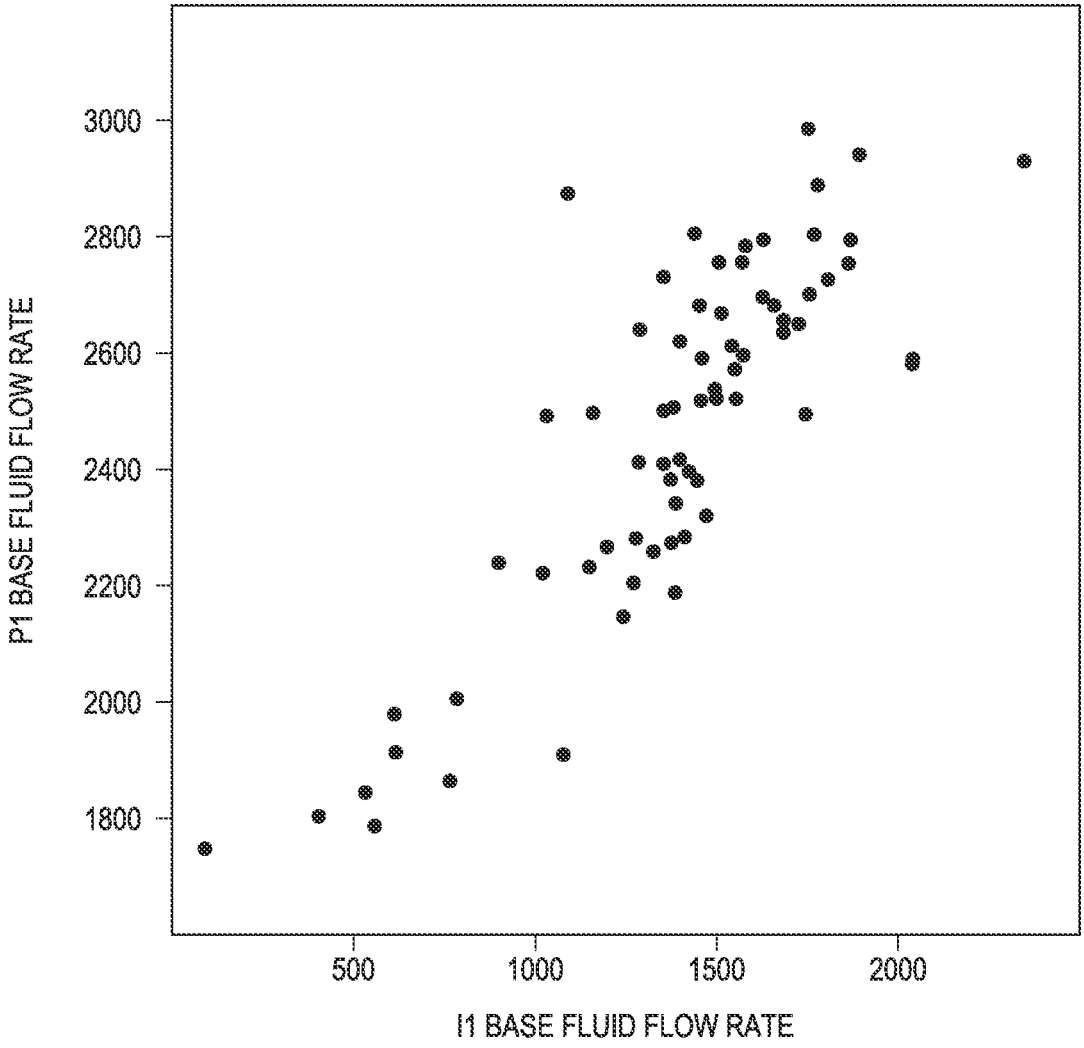
FIGS. 5*a* through 5*d* are various plots of examples of injector measurement data and identified injector events, as may be generated in identifying injector events, according to the embodiment shown in FIGS. 4*a* and 4*b*.

FIGS. 4*a* and 4*b* illustrate the operation of process 42 in more detail, according to an embodiment of the invention. In particular, process 42 involves the identifying of events at injectors I1 through I5 that have some likelihood of being related to a response at one or more of producers P1 through P7 of production field 6. In this embodiment of the invention, process 42 begins with process 54 (FIG. 4*a*) in which correlation cross-plots of injector flow rate and producer flow rates are displayed at workstation 21, allowing visualization of the general relationship of daily flow rate at a selected injector $I_j$ plotted against daily flow rate at a selected producer $P_k$, for days within a time range as interactively selected by the user. The manner of selection of producer $P_k$ and the relevant time range is contemplated to be within the judgment of the user, as may be enlightened by the measurement data obtained in process 40. For example, FIG. 5*a* shows an example of a cross-plot of base fluid flow rate (i.e., the flow rate of all fluid) at producer P1 versus base fluid flow rate at injector I1, over a selected period of time. In this FIG. 5*a*, each data point corresponds to a specific day within the selected period of time at which the base fluid flow rate at both injector I1 and producer P1 are non-zero. Workstation 21 or another computing resource in system 20 may additionally calculate a correlation coefficient, in the conventional manner, to lend the user further insight into the general relationship in flow rate. In the example of FIG. 5*a*, the user can conclude that the flow rates at injector I1 and producer P1 are generally correlated, and that producer P1 is then a candidate for further investigation in identifying injector events at injector I1 in this process 42. Other injector-producer pairs can then be similarly investigated in process 54, as a result of which the user may include and exclude various pairs from further investigation. Other data streams, such as bottomhole pressure (BHP), bottomhole temperature, wellhead temperature, in both injectors and producers, can also be used in this analysis.

Process 42 next continues with process 56, in which system 20 performs an interactive automated process of identifying injector events. It is contemplated that various approaches to injector event identification can be applied according to this invention. A particularly beneficial approach to injector event identification process 56, according to one embodiment of the invention, will now be described with reference to FIG. 4*b*.

Figure 5B:
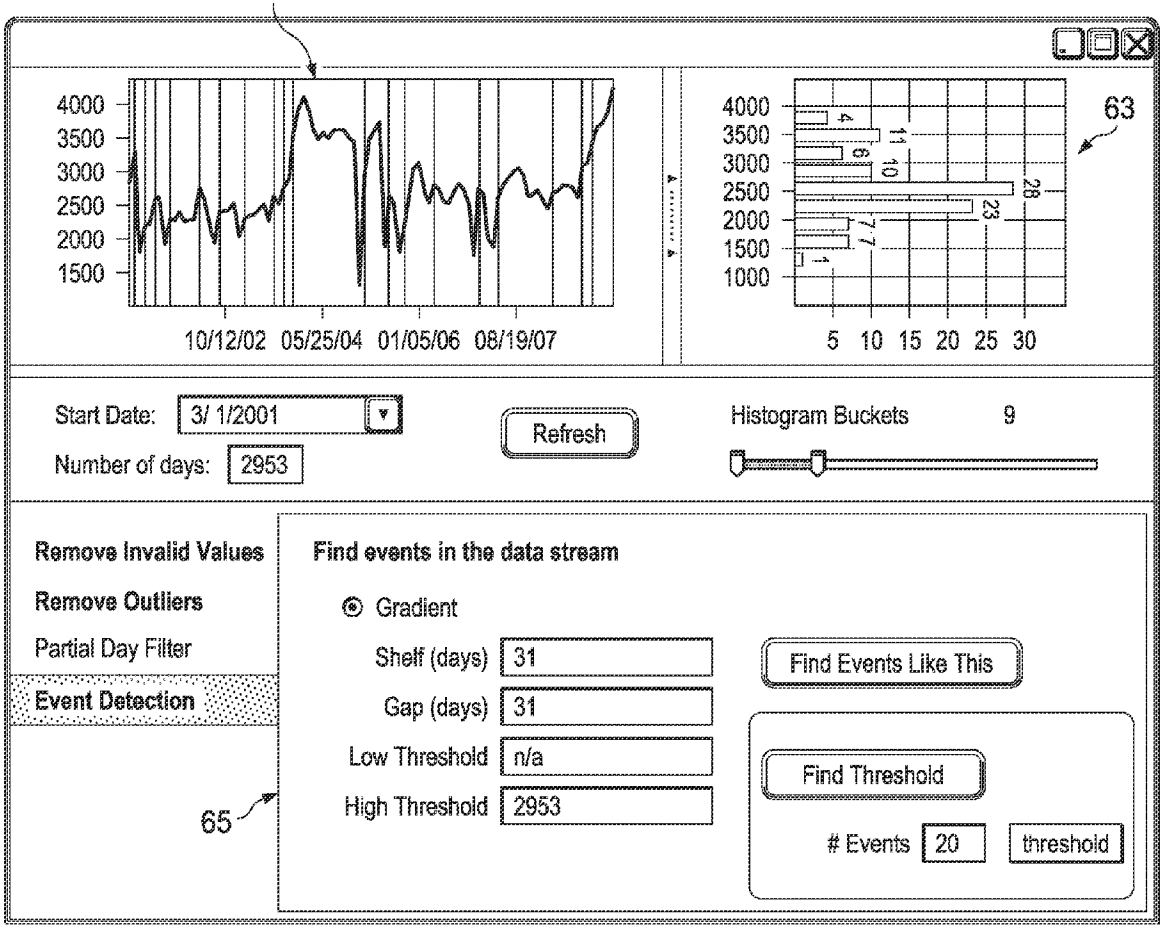

Identification process 56 begins with process 60, in which workstation 21 displays to the user a time series of measurements (as processed by process 52 described above) corresponding to flow rate for a selected injector $I_j$. According to this embodiment of the invention, this time series displayed in process 60 is a time series of injection flow rate over time. Alternatively, the time series displayed in process 60 may correspond to a different measurement, for example bottomhole pressure over time. FIG. 5*b* illustrates an example of such a time series of injection flow rate in frame 61 of a display at workstation 21, as acquired over a historical period of time. In this example, some amount of averaging has been applied by system 20, smoothing out the individual data points in the injection flow rate illustrated for this selected injector $I_j$. Additional display tools can also be provided as a result of process 60, including, for example, a histogram tool illustrated in frame 63, by way of which the user can view the distribution of flow rates in the time series displayed in frame 61.

As shown in FIG. 5*b*, interactive tools are also provided to the user by workstation 21 in frame 65, by way of which process 62 can be executed by system 20 to identify potential injector events in the currently selected time series. In frame 65, the user can define various criteria by way of which system 20 identifies potential events in this process 62. For example, as shown in FIG. 5*b*, the user can select the sampling period ("gap") between time points in the displayed time series at which instantaneous backward-looking and forward-looking gradients are calculated, along with the duration ("shelf") over which each of those gradients are to be calculated. Threshold values by way of which events are identified are also shown in frame 65. For example, as shown in FIG. 5*b*, a high threshold value of about 250 is operative; time points at which a change between backward-looking and forward-looking gradients exceeds this value will be identified as potential events in response to the user actuating the "Find Events Like This" button in frame 65. Alternatively, the user can enter a number of events to be identified in the time series displayed in frame 61 (e.g., 20 events, as shown in FIG. 5*b*); upon the user actuating the "Find Threshold" button, the threshold values will be calculated. In either case, potential injector events are shown in frame 61 as vertical lines at specific points overlaying the time series of flow rate over time. It is contemplated that the user can interact with system 20 in this manner to identify potential injector events for subsequent analysis. Of course, other approaches in carrying out event identification process 62 may be alternatively implemented. A particularly beneficial approach toward identifying significant changes in gradient in time series representations will be described in detail below, in connection with the identification of producer events; this approach may also be used in process 62 in identifying potential injector events.

Referring back to FIG. 4*b*, system 20 next executes process 64 to allow the user to visualize selected injector events as identified in process 62, and to visualize possible responses to those injector events by producers P1 through P7 in the same production field 6. This process 64 allows the user to determine whether the identified potential injector events may invoke a corresponding response in the produced flow rate. According to this embodiment of the invention, visualization process 64 displays a focused (in time) view of a selected injection flow rate, in combination with corresponding flow rates at one or more producers P1 through P7 at about the same time, to assist in this verification.

Figure 5C:
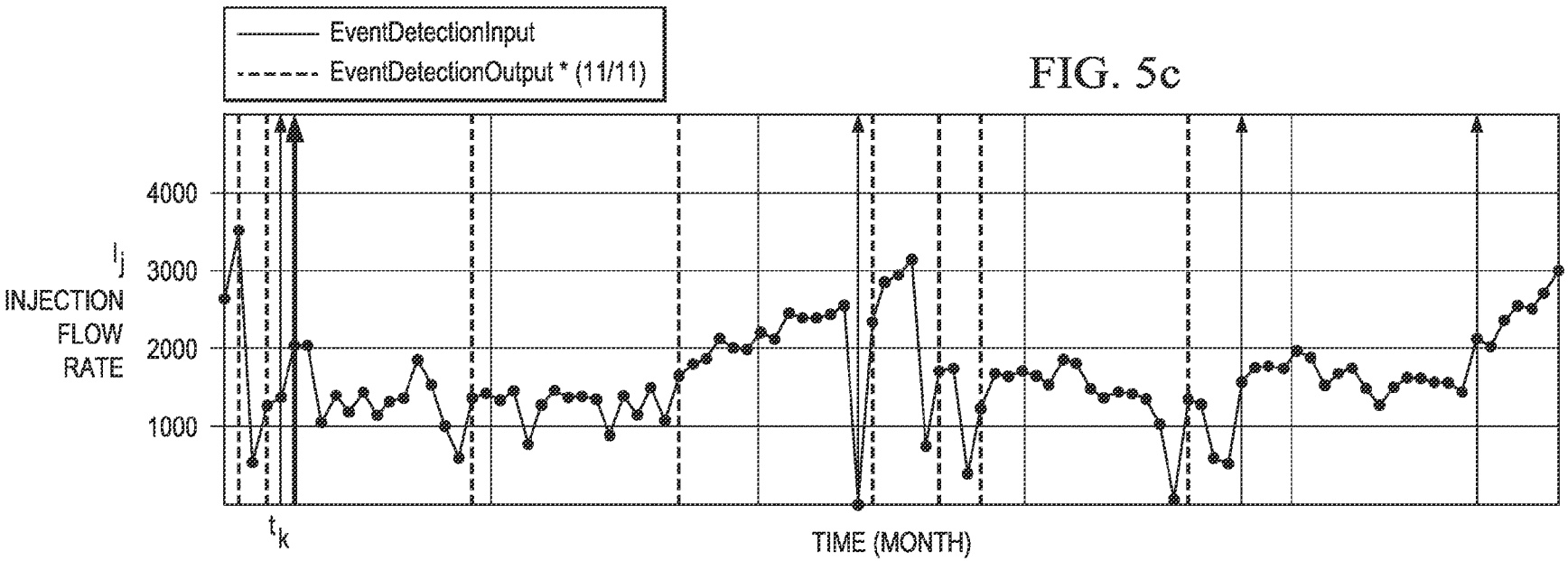

FIG. 5*c* shows an example of a time series of flow rates, displayed at workstation 21, including potential events as identified by process 62 in that time series. As in FIG. 5*b*, the potential events are indicated by vertical lines. The flow rates illustrated in FIG. 5*c* correspond to the particular sampling points as identified in process 62, for example at a time of every 31 days as selected in frame 65 in the example display of that Figure. In this example of FIG. 5*c*, the user has interactively selected the event at time $t_k$ for visualization. Also at this point in the interactive process, the user may have selected one or more time series for investigation of possible responses to this potential injector event at time $t_k$ from the available time series.

Figure 5D:
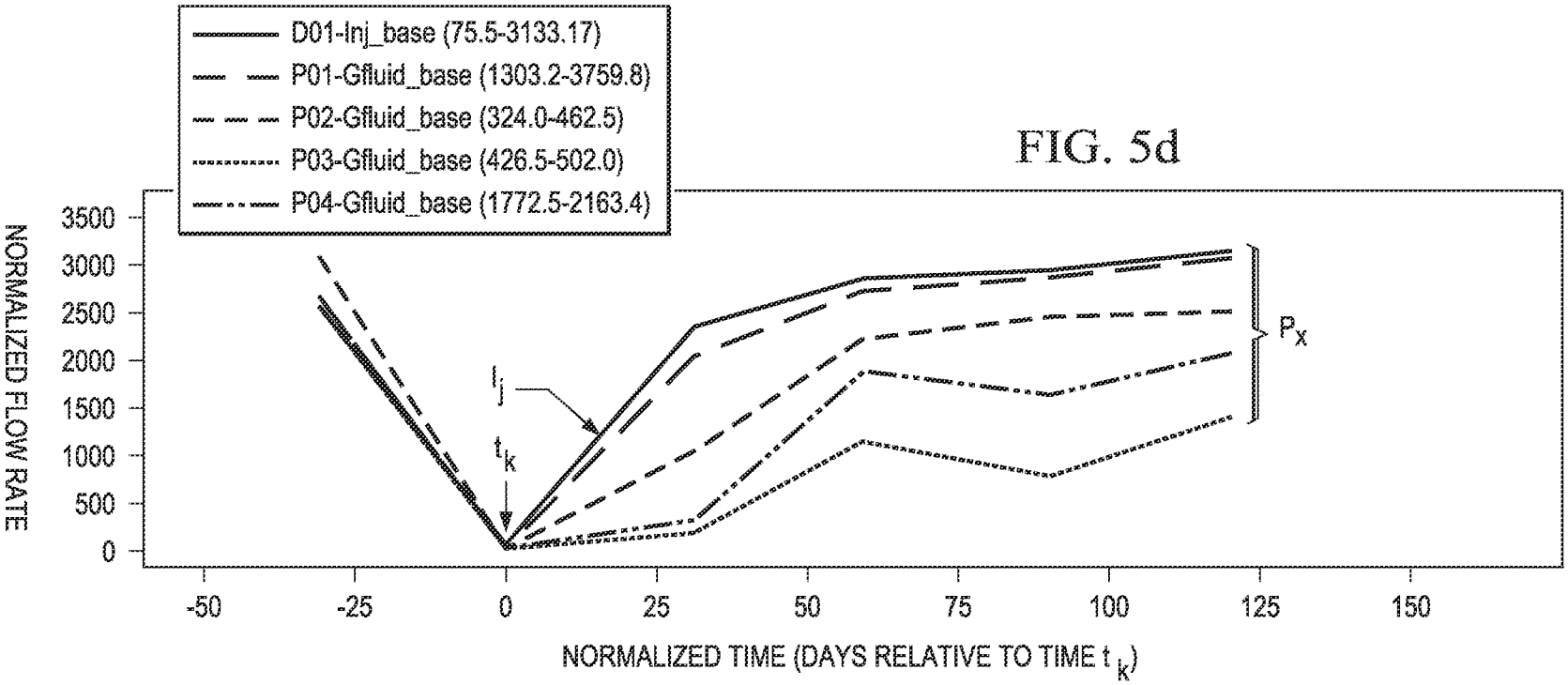

Visualization process 64 according to this embodiment then generates a display of the selected injector flow (e.g., for injector $I_j$ in this example) along with one or more response time series selected by the user. For example, the selected response series may be one previously found, in correlation cross-plot process 54, to have a reasonable correlation to injector $I_j$. Process 64 generates a visualization of the selected time series so that the user can readily compare the shapes of the potential response time series with the shape of the selected potential injector event, to determine whether sufficient plausible correlation is present to further investigate the injector event by subsequent processing (described below). To perform this visualization, system 20 considers a relatively short time period on either side of the selected event time $t_k$ (such a time period being user-selectable), normalizes the amplitude of the selected time series within that time period under consideration, and also normalizes the times at which a corresponding change in gradient in each of the selected responses occur. FIG. 5*d* illustrates an example of a visualization generated in this process 64, according to an embodiment of this invention, for the selected potential injector event at time $t_k$ as shown in FIG. 5*c*. As evident in this overlay plot of FIG. 5*d*, each of the selected time series plots are averaged to the same sampling period of the injector $I_j$ flow rate; the normalization in time shifts forward the responses shown by plots $P_x$ to coincide with the change in gradient in injector flow rate $I_j$ at time $t_k$ (time 0 of FIG. 5*d*). Of course, in reality, some finite delay (generally in days) between the potential injector event at time $t_k$ and any actual response will be present. In this example, the visualization of FIG. 5*d* extends from sixty days prior to time $t_k$ to about 120 days after time $t_k$. As shown in FIG. 5*d*, one response curve closely mimics the time series curve of injector $I_j$ flow rate; others vary in their fidelity with the injector flow rate.

Upon the user finishing analysis of a potential injector event via process 64, as shown in FIG. 5*d*, system 20 operates to receive an input from the user indicating whether the potential injector event is verified (i.e., appears to invoke a response at one or more of the producers) or is rejected (i.e., does not show a response at a producer, thus not corresponding to an actual injector event or corresponding to an event that need not be further considered), in process 66 of FIG. 4*b*. This interaction between the user in processes 64, 66 is repeated for each of the potential injector events identified by process 62 for the current injector $I_j$, to the extent desired by the user. Upon completion of the analysis of potential injector events at one injector, decision 67 is executed to query the user whether additional injectors remain for analysis. If so (decision 67 is "yes"), then another injector $I_j$ is selected in process 68, and the process is repeated for that injector $I_j$ beginning from process 60.

Referring back to FIG. 4*a*, upon all desired injectors having been analyzed by process 56 (decision 67 is "no"), injector event identification process 42 is completed by the exporting of data indicating the various verified injector events. These exported data will include identification of the injector and the time at which the verified event occurs, and also a "magnitude" of the event. More specifically, the event magnitude is an indication of the size of the event relative, in a functional sense, to the change in cumulative injection flow rate over a user-selected time period (i.e., a "shelf" period). Inclusion of a measure of event magnitude can serve as the basis for selection of subsets of the complete injection event set. In addition to being based simply on event magnitude, this selection may consider the consistency of event magnitudes at each producer in response to injection events; those producers that do not respond consistently to large injection events may be considered to be less reliably connected than those that respond consistently to those events. Other data, such as the time delays of corresponding responses (known from the normalization performed in connection with process 64), and other attributes of the corresponding responses, may be included within the exported data. These exported data are in a format suitable for use by system 20 in process 44 (FIG. 3) to detect producer events and the association of those producer events with injector events, as will be described below. For example, the format of the exported data may be a spreadsheet.

The particular implementation of processes 40, 42 in identifying potential injector events can vary from that described above in connection with FIGS. 4*a* and 4*b*. For example, the data importation and filtering of processes 50, 52 can be performed for individual injector flow rate time series after selection by the user (i.e., after selection process 68 in each pass through process 56) if desired; alternatively, as suggested by the above description, the importation and data filtering can be performed for all injectors of interest prior to identification process 42. These and other variations in the implementation of processes 40, 42 will be apparent to those skilled in the art having reference to this specification.

In this regard, one such variation in the implementation of processes 40, 42, more specifically as a preparatory step in the injector event analysis, is to identify isolated events in the time sequence of the population of injectors. Because injectors are often subjected to simultaneous changes under operator control (human or automated), or as a consequence of mechanical, electrical, or other interruptions that cause loss of injection at all or a subset of injectors, it can be difficult to resolve which of the injectors is potentially responsible for a change at a producing well. On the other hand, isolated events at single injection wells are not subject to this uncertainty, and are thus relatively more revealing about connection pathways in the reservoir. As such, the automated detection of isolated injector events, as opposed to events common to some or all injectors, can be quite useful in assisting the search among plausible responding producer wells, and can be realized in the system and method of embodiments of the invention, as will be described below.

In one approach, according to embodiments of the invention, the search for isolated injection well events extends isolated event marking to individual wells, accounting for the direction of changes. Because the expected physical behavior of injection fluids is increased production with increasing injection rates and falling production with decaying injection rates, an isolated injection increase at one injector simultaneous with decreasing injection at multiple other injectors can be regarded as an isolated event, and retained for pattern matching with production variation (both visually as described above, or via numerical scores as will be discussed in further detail below). In another variation, compensation for the time of flight between wells, allowing for differences in distance between producers and injectors, is applied in testing for simultaneity as perceived at each of the target producers. This travel time compensation is contemplated to be especially useful as applied to data resolved more frequently than on a daily basis (e.g., every three to six hours).

Another refinement in the isolation of injector events identifies periods during which no injector activity occurs, particularly after genuinely isolated or pseudo-isolated (i.e., only other contemporaneous injector events are all in the opposite direction to a single other injection event). Because these periods are devoid of multiple other 'masking' events, suggestions of plausible injector/producer well pair connections can be more readily detected during these quiet periods. While it is contemplated that the numerical "scores" of these isolated events are likely to be weak, due to the low incidence rate of such events, these isolated events are likely to give useful leads that can direct the path of the investigation.

Referring back to FIG. 3, upon completion of the identification of injector events in process 42, system 20 next analyzes measurement data pertinent to production flow rate from producing wells P1 through P7 in production field 6 (FIG. 1) in process 44. According to embodiments of this invention, the measurement data analyzed in process 44 can include direct measurement of flow rates at each of the producers P1 through P7 of interest, allocated flow rates for the individual producers as calculated from commingled measured flows, calculated or estimated flow rates for each phase of interest from a measured multi-phase flow, or calculated flow rates based on temperature, pressure, or other indirect ("proxy") measurements downhole or at the wellhead of each of the producers. In addition, the analysis of process 44 may be performed on values other than measured or calculated flow rates, such as bottomhole pressure (BHP). In addition, as will become apparent from the following description, measurement data pertaining to flow rates etc. at injectors I1 through I5 of production field 6 may also be analyzed by process 44, as well as the information derived from process 42 in which injector events were identified, and additionally characterized if desired. The measurement data can be corrected to "reservoir barrels" to normalize the analyses to a consistent basis, both within an individual well's flow characteristics despite changes in GOR and water cut, and relative to other producing and injecting wells. These higher frequency measurement data, as compared with reconciled and allocated well flow, enable the resolution of intra-well events with close precision in time. By doing so, entire days of allocated production flow need not be masked (i.e., removed) from the analysis in order to eliminate intra-well effects. As a result, measurement data from a greater overall proportion of the time period under analysis can remain available for the identification and development of associative inter-well connections and relationships.

As known in the art, wells are subject to many and various alterations arising from changes to the independent variables on the well, typically as made by a human operator. However, the intervention of automated actions, whether initiated by control or safety systems or by human operators, causes frequent variations in production and other dependent variables (e.g., pressures and temperatures), for reasons not primarily due to interaction with injection wells. As such, another useful preparatory step corrects the allocated production for such effects, prior to analysis for inter-well effects. As a simple example, if a well operated for twelve hours in a given day, its allocated flow would likely be around half that of a full day's operation. Multi-variable linear regression can be used to correct for all the independent variable changes, with the resulting file of "corrected" flows passed on to the data filtering and outlier removal steps, according to embodiments of the invention. Outliers that could distort the linear regression, for example zero hour production or zero choke openings, cannot usefully be corrected to 24 hour values and thus should be handled accordingly. Values that are physically unrealistic or used as error codes (e.g., negative valve openings) can be excluded.

As known in the art, wells that have been in a non-flowing condition for a period of time will recover pressure upon reinstatement, following which their flow will thus tend to higher than the expected rates for a period of time. Multiple linear regression can correct production to modal, or "expected", values of these independent variables, for example by using an exponential correction for periods between zero days on-line since restart and a number of days appropriate to a return of the well to a "normal" drawn-down pressure state. Additional parameters describing the shut-in period can further improve this correction.

Figure 6:
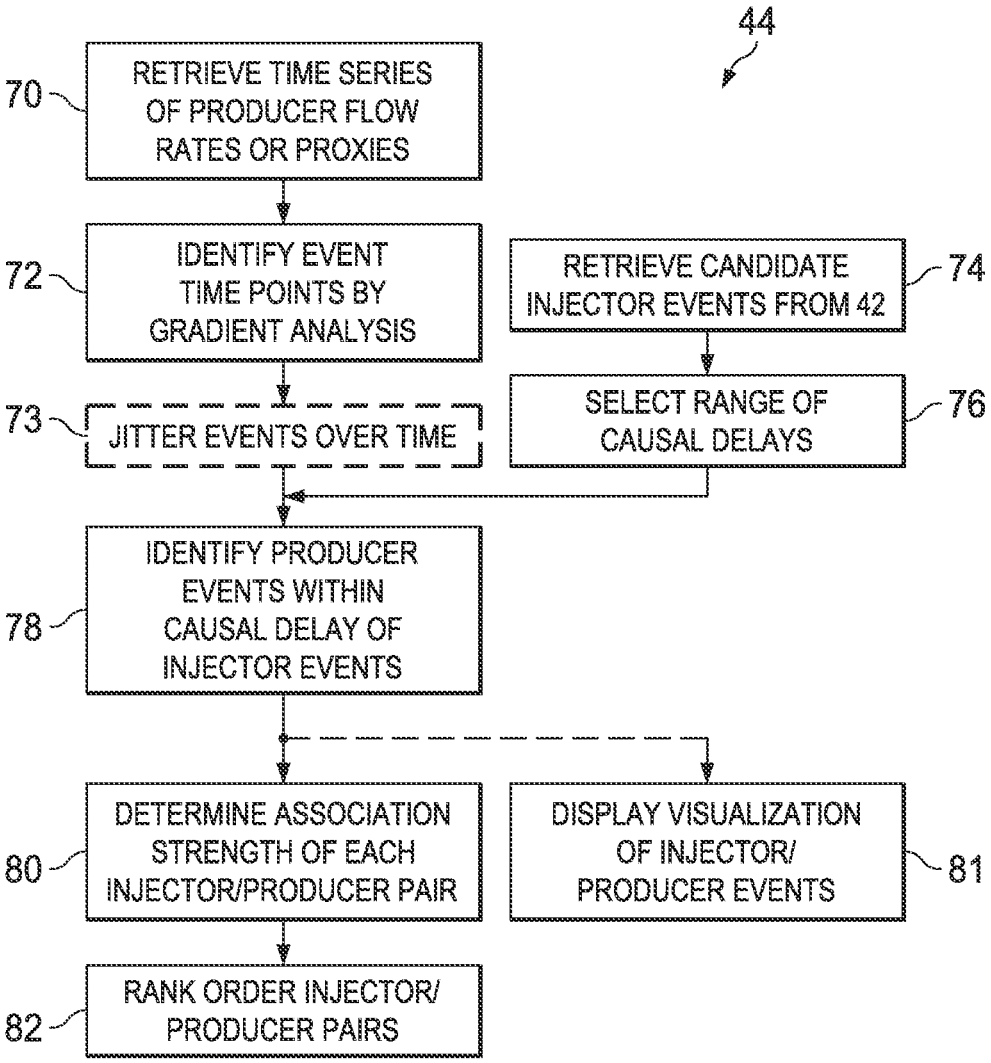
FIG. 6 is a flow diagram illustrating the operation of the system of FIG. 2 in identifying producer events in the operational flow of FIG. 3, according to an exemplary embodiment herein.

Referring now to FIG. 6, the operation of system 20 in executing process 44 will now be described in detail. In connection with producer measurement data, process 44 begins with process 70, in which system 20 retrieves measurement data in the form of, or suitable for arrangement as, one or more time series for each producer P1 through P7 of interest. These measurement data are obtained from the appropriate data source, including by obtaining recent measurements directly obtained from flow meters and other sensors in the field via measurement inputs 28, and retrieving historical measurement data stored in data library 32 and available to workstation 21 via network interface 26 and server 30. As mentioned above, the measurement data obtained in process 70 can include historical flow rate measurements (including measurements for separate phases of multi-phase flows) from each producer P1 through P7 of production field 6, flow rates for those wells as calculated from indirect measurements at the wells (e.g., from pressure and temperature measurements), as well as other well measurements such as bottomhole pressure (BHP).

It has been observed, in connection with this invention, that time series representations of cumulative production from producing wells is a particularly useful set of measurement data for purposes of evaluating secondary recovery actions, according to embodiments of this invention. Cumulative production data are useful in this regard, because such data naturally reflect the reduction in reservoir pressure from a production field over time, and the corresponding typical fall-off in flow rate. As such, for purposes of this description, the time series measurement data retrieved in process 70 will be referred to as cumulative production data. Of course, as described above, other measurement data, and calculated values, as the case may be, may alternatively or additionally be retrieved and analyzed according to embodiments of this invention.

As in the case of obtaining measurement data pertaining to injectors I1 through I5, it is contemplated that the time duration over which these measurements are obtained may be relatively long, up to months or years. As mentioned above, because changes in well count typically changes the injector-producer relationships in the field, the measurement data retrieved in process 70 and analyzed according to embodiments of this invention may be constrained to a particular "epoch" in which the injector and producer well count is constant, and repeated for each well count epoch over the time period of interest. Process 70 also preferably includes various filtering and processing of these measurement data, as may be suitable for analysis according to embodiments of this invention, as described above. In addition, retrieval process 70 may correspond, in whole or in part, to processes 40, 42 described above in connection with the initial retrieval of measurement data prior to identifying injector events; alternatively, process 70 may apply different or additional selection or filtering criteria as desired. Other pre-processing of the retrieved measurement data can also be applied within process 70. For example, the measurement data for a given well can be normalized to modal values of that well's own independent operating parameters, so that intra-well effects during production are automatically compensated prior to establishing "events" indicative of interwell communication. More specifically, each well's performance can be linearly regressed against its own variables such as, but not limited to, choke position, gas or other lift parameters (e.g., flow, pump speed, etc.), and hours on line. Upon selecting one input from each correlated pair of inputs (e.g., inputs with correlation >0.8), the measured well flow can be corrected back to its expected value in the absence of the variation in intra-well parameters relative to their modal value.

In this embodiment of the invention, the time series data retrieved in process 70 for one of producers P1 through P7 are analyzed to detect potential producer events by way of a gradient analysis, in process 72. In a general sense, this gradient analysis process 72 analyzes the time-rate-of-change over a period of time at a selected point of interest, to determine whether a statistically significant change in the gradient of the measurement values occurred at that point in time. Such significant changes in the gradient of the measurement data (e.g., reflecting changes in the flow rate from the producing well) can indicate an event that is of interest in evaluating the effects of injection at one or more injectors in the field. More specifically, as known in the art, significant changes in the rate of change of the output flow rate of a producing well will occur responsive to changes in the injection rate at an injector in the same production field, if significant connectivity between the injector and producer is present in the sub-surface. As discussed above, it is these inter-well effects that are of interest in connection with this invention, because knowledge of the interaction between injectors and producers is important in optimizing management of the reservoir by way of secondary recovery actions. Conversely, the intra-well effects of gas lift, choke valve settings, and similar actions at the producing well itself, as reflected in changes in the outflow from that well, are of less interest for purposes of this invention; indeed, in some cases these intra-well effects can degrade visibility into the injector-producer interaction that is to be optimized.

Figure 7:
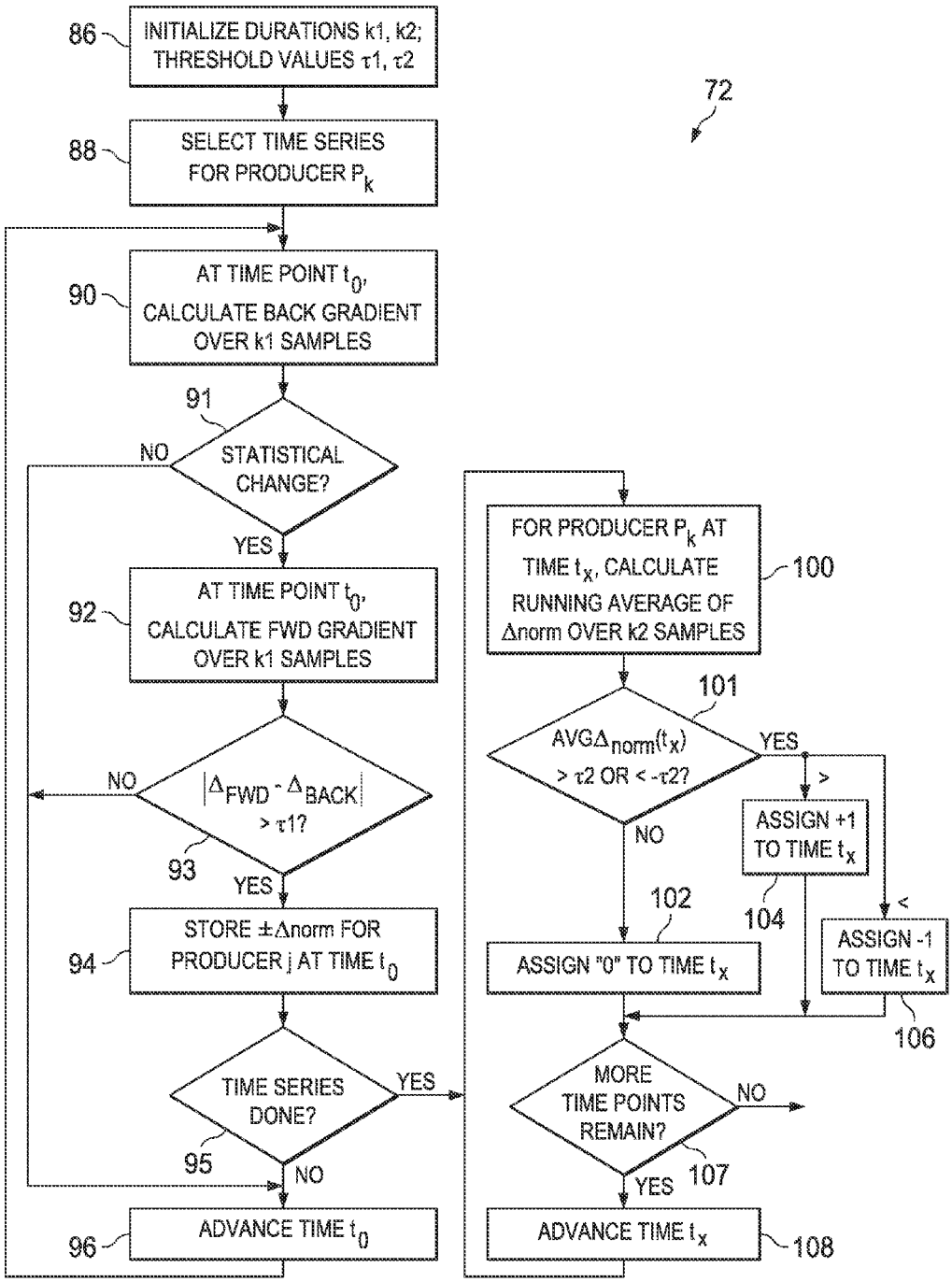
FIG. 7 is a flow diagram illustrating a method of performing gradient analysis to detect producer events, according to the embodiment shown in FIG. 6.

Referring now to FIG. 7, the operation of system 20 in carrying out analysis process 72 according to an embodiment of this invention will now be described in detail. As will become evident to those skilled in the art having reference to this specification, the manner in which process 72 is executed according to this embodiment of the invention has heightened sensitivity to the detection of inter-well effects (such as injector-producer relationships) in combination with reduced sensitivity to intra-well effects that are of less interest in secondary recovery.

According to this embodiment of the invention, gradient analysis process 72 is initialized in process 86 with selected values of a gradient duration k1, an averaging duration k2, and threshold values $\tau 1$, $\tau 2$ for use in the operation of process 72. It is contemplated that these initial values will be selected based on attributes of injector events as indicated by injector event identification process 42. Alternatively, these initial values may be based on past optimization results, characterization of this or similar production fields, or based on theory. Alternatively, it is contemplated that one or more of these values may be varied over iterations of process 72, to improve the statistical robustness of the optimization over an ensemble of values. In process 88, the time series of measurement data for a particular producer $P_k$ is selected, as is a point in time $t_0$ along that time series at which analysis is to begin.

In process 90, system 20 evaluates a back gradient in the time series of measurement data from selected time $t_0$ over the k1 samples prior to that time. Certain criteria may be applied to this back gradient calculation, including a minimum number of valid data points within those k1 samples. For example, if k1 is initialized to seven days, then a minimum number of four valid samples within those seven prior days may be required. Process 90 is executed by system 20 according to a conventional "best fit" or curve-fitting algorithm, such as least squares, and a correlation coefficient (e.g., $R^2$), or other measure of fit of the data to the regression line from which the gradient is determined, is calculated to quantify the degree to which the data points fit the regression line. An alternative statistical test suitable for process 90 is a two-tailed t-test, for which a user-selected p criterion is used to determine whether a genuine change in slope has occurred.

In decision 91, system 20 evaluates whether fit of the regression line at time $t_0$ is significantly poorer, in a statistical sense, than the fit of the data to the regression line as calculated at the previous sample time. If not (decision 91 returns a "no"), decision 95 determines whether analysis of the time series is complete or if instead additional points in the time series remain to be analyzed. If decision 95 determines that such additional points remain (its result is "no"), time of interest $t_0$ is advanced (process 96) and process 90 is repeated. For the first pass through process 90, decision 91 will of course be a nullity, and process 90 will be repeated at the next point in time along the time series. If, however, the fit of the measurement data including the data point at current time $t_0$ degrades significantly from the fit at the previous point in time $t_{-1}$, this poorer fit may indicate a response at producer $P_k$ to an injection event.

According to this embodiment of the invention, therefore, decision 91 determines whether the measure of fit (e.g., correlation coefficient) of the measurement data (e.g., cumulative production) to the backward-looking regression line is poorer at time $t_0$ than it was at the previous point in time $t_{-1}$ by a significant degree. For example, the criteria of decision 91 may evaluate whether correlation coefficient $R^2(t_0)<0.97R^2(t_{-1})$. If so (decision 91 is "yes"), system 20 next performs process 92 to calculate a gradient of cumulative production (or other attribute of the measurement data under analysis) over k1 sample points forward in time from time $t_0$. The number of sample points forward in time, over which the forward gradient is calculated, may differ from the number of sample points over which the back gradient is calculated in process 90, if desired (and depending on the available valid data over that sample time period).

Figure 8A:
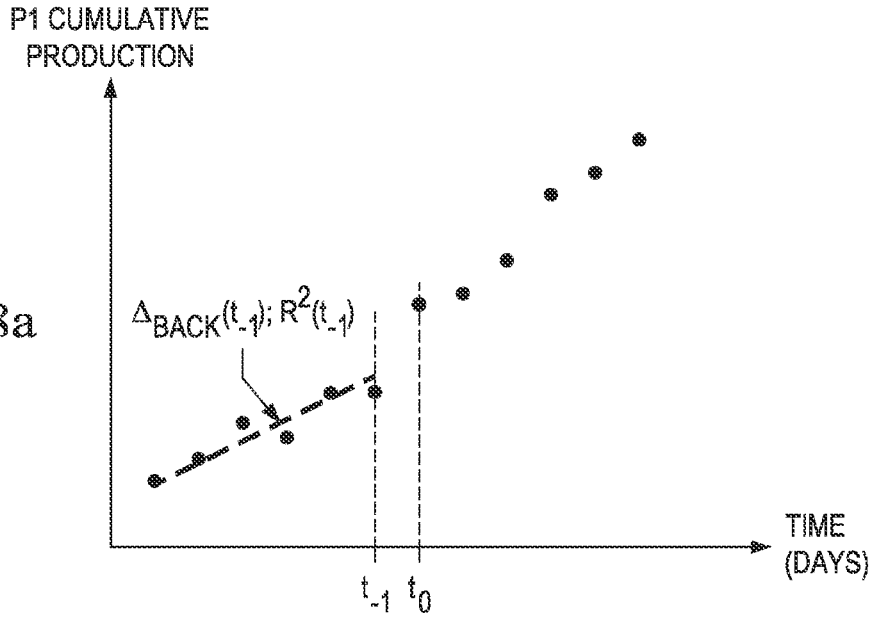
FIGS. 8*a* through 8*c* are plots of cumulative production measurement data for an example of a producing well, illustrating the gradient analysis according to the embodiment of FIG. 7.
Figure 8B:
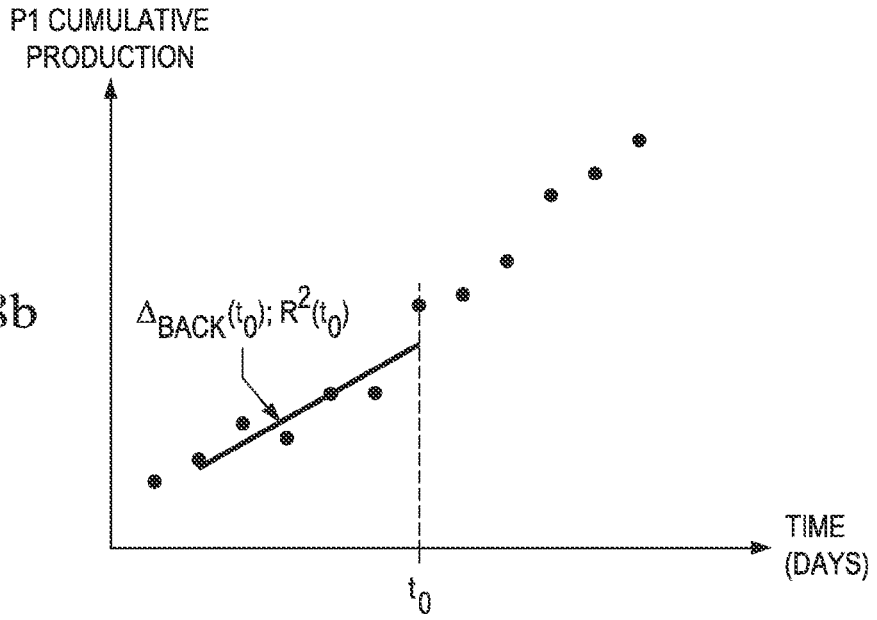
Figure 8C:
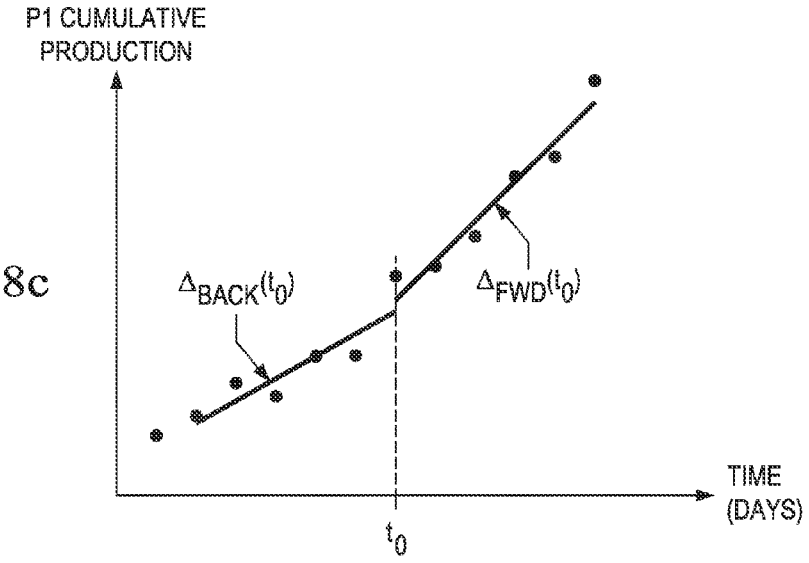

FIGS. 8*a* through 8*c* illustrate an example of the operation of processes 90, 92, for a sample data set of cumulative production from producer P1 over a range of several days. In FIG. 8*a*, the result of a prior instance of process 90 is illustrated by way of a regression line for the back gradient of the six data points including time $t_{-1}$ and the five previous samples. As shown in FIG. 8*a*, this previous instance of process 90 executed a least-squares best fit regression to a line having a slope of back gradient $\Delta_{BACK}(t_{-1})$. A correlation coefficient $R^2(t_{-1})$ was also calculated in that instance of process 90 for time $t_{-1}$ and its preceding samples. In FIG. 8*b*, the result of process 90 at time $t_0$ is illustrated, with a regression line illustrated for time $t_0$ and its preceding five data points. The slope of this regression line is back gradient $\Delta_{BACK}(t_0)$, and the fit of the data to this regression line is indicated by correlation coefficient $R^2(t_0)$. As evident from FIG. 8*b*, a significant increase in cumulative production at producer P1 occurred at time $t_0$. For purposes of this example, this instantaneous increase in cumulative production at time $t_0$ worsens the fit of the regression line for time $t_0$ from that taken at time $t_{-1}$, by an amount that meets the threshold of decision 91 (i.e., decision 91 is "yes"). As a result, process 92 is executed for the data at time $t_0$, to derive a best fit regression for the cumulative production at time $t_0$ and over the next five samples in time, to assist in determining whether this instantaneous increase at time $t_0$ may constitute an event at producer P1. The result of process 92 is illustrated in FIG. 8*c*, by the regression line extending forward in time from time $t_0$. That regression line has a slope of forward gradient $\Delta_{FWD}(t_0)$. As evident from FIG. 8*c*, the forward gradient $\Delta_{FWD}(t_0)$ at time $t_0$ has a noticeably steeper slope than does the back gradient $\Delta_{BACK}(t_0)$ at that time.

Referring again to FIG. 7, once system 20 has calculated a forward gradient over the next k1 samples from the current analysis time $t_0$ in process 92, decision 93 is next executed to determine whether the difference between the forward and back gradients at time $t_0$ exceed a threshold $\tau$1 (set in process 86). For example, threshold $\tau$1 may correspond to the average increase in cumulative production over the respective k1 time periods, divided by five. If the change in slope between the forward and back gradients exceeds this threshold $\tau$1 (e.g., if $|\Delta_{FWD}-\Delta_{BACK}|>\tau 1$), decision 93 returns a "yes" and process 94 calculates a normalized gradient differential value $\Delta_{norm}(t_0)$, and stores that normalized value in memory, associated with time $t_0$. For example, the normalized gradient differential value $\Delta_{norm}$ may correspond to a signed value (the sign indicating the direction of change in gradient at time $t_0$) with a magnitude corresponding to the ratio of the difference between forward and back gradients to threshold $\tau$1. For example, process 94 may simply calculate:

$$\Delta_{norm} = \frac{\Delta_{FWD}(t_0) - \Delta_{BACK}(t_0)}{\tau 1}$$

This value may be rounded to the nearest integer, if desired, for ease of storage and calculation. This value allows events to be detected on a normalized basis relative to threshold $\tau$1. Control then passes to decision 95 to determine whether the time series has been fully evaluated. Decision 95 is also executed if the change in slope does not exceed threshold $\tau$1 (decision 93 is "no"), as the change in slope is considered to not correspond to a potential injector-producer event.

Upon completion of analysis of the time series for producer $P_k$ (decision 95 is "yes"), system 20 next performs a smoothing of the event over time, beginning with process 100. According to embodiments of this invention, this smoothing over time converts significant changes in gradient in the measurement data time series (e.g., significant changes in the rate of change of cumulative production) from a representation of the change having a large magnitude into a representation of the change having a large effect in time. It has been discovered, according to this invention, that this time-spreading facilitates distinguishing between large and small events, and also improves the ability of system 20 to detect events, given the uncertainties in delay time between injector and producer events typically observed in actual production fields. In addition, it has been discovered, according to this invention, that the approach described above in identifying potential producer events by analysis of change in gradient, especially in combination with the time-spreading of process 100 et seq. to be described below, tends to filter out the first-order effects of "intra-well" actions in the production field, such as gas lift, changes in choke valve position, and the like that are carried out at the producing well itself. This intra-well filtering occurs regardless of whether the allocated flow data was first adjusted for known variations in independent well variables (e.g., hours on-line, choke position, gas lift rate, time since restart, etc.), as discussed above.

According to this embodiment of the invention, process 100 is next executed for the selected producer $P_k$. The time series of normalized gradient differential values $\Delta_{norm}$ for that producer $P_k$ are retrieved, and a running average of normalized gradient differential $\Delta_{norm}$ is calculated over k2 time samples surrounding or otherwise including a sample time $t_x$;

the duration value k2 is one of the values initialized in process 86, and is selected based on prior observation, characterization, or theory. In decision 101, system 20 evaluates, for the current analysis time $t_x$, whether the absolute value of running average $AVG\Delta_{norm}(t_x)$ exceeds threshold $\tau 2$. Threshold $\tau 2$ is similarly defined or initialized in process 86, from prior observation, characterization, or theory, or is adjusted in order to compute a desired number of events. Threshold $\tau 2$ takes both a positive value and a negative value, in this embodiment of the invention, as the injector-producer analysis in this example considers not only the magnitude but the direction (i.e., greater flow, lesser flow) of the potential producer event. Additionally, if desired, multiple iterations of time-smoothing process 100 may be performed over an ensemble of values k2, $\tau 2$, etc., to improve the robustness of the event identification and association.

According to this embodiment of the invention, decision 101 compares each value of running average $AVG\Delta_{norm}(t_x)$ as a signed value, against each of the thresholds $+\tau 2$, $-\tau 2$. If running average $AVG\Delta_{norm}(t_x)$ at time $t_x$ has a positive value greater than threshold $+\tau 2$, system 20 assigns a "+1" value to time $t_x$ in process 104; if running average $AVG\Delta_{norm}(t_x)$ has a negative value less than threshold $-\tau 2$, system 20 assigns a "−1" value to time $t_x$ in process 106. If running average $AVG\Delta_{norm}(t_x)$ at time $t_x$ has a value between threshold $-\tau 2$ and threshold $+\tau 2$, system 20 assigns a "0" value to time $t_x$ in process 102.

Figure 9A:
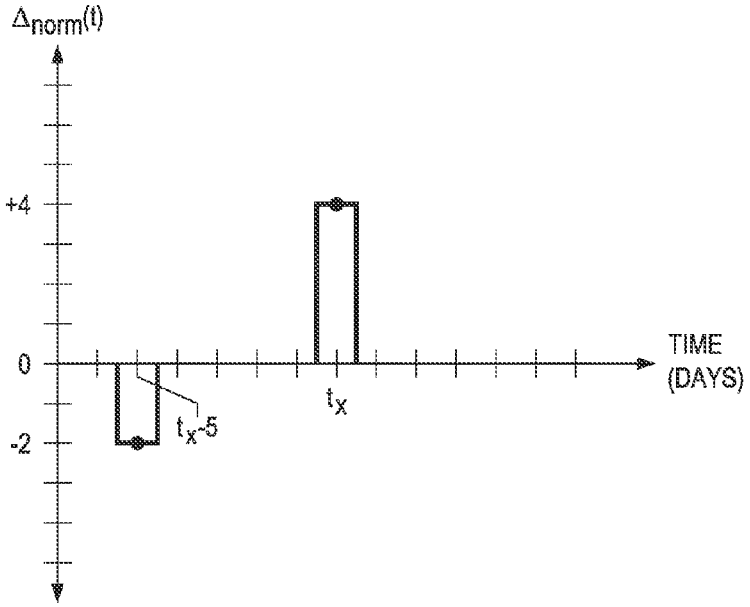
FIGS. 9*a* through 9*c* illustrate an example of the averaging and time-smoothing applied to potential producer events detected according to the embodiment shown in FIG. 7.
Figure 9B:
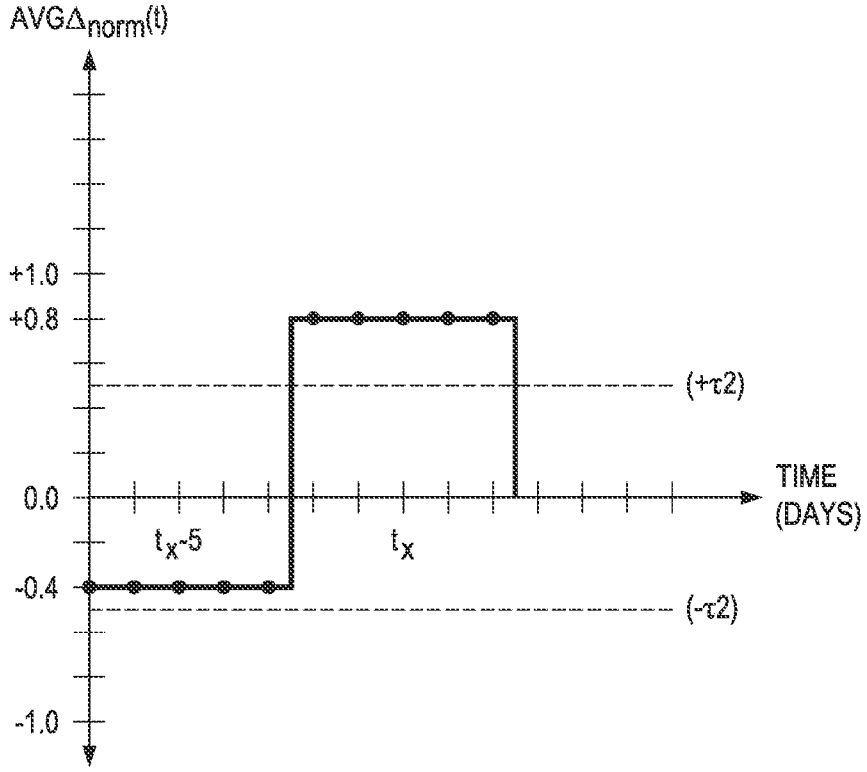
Figure 9C:
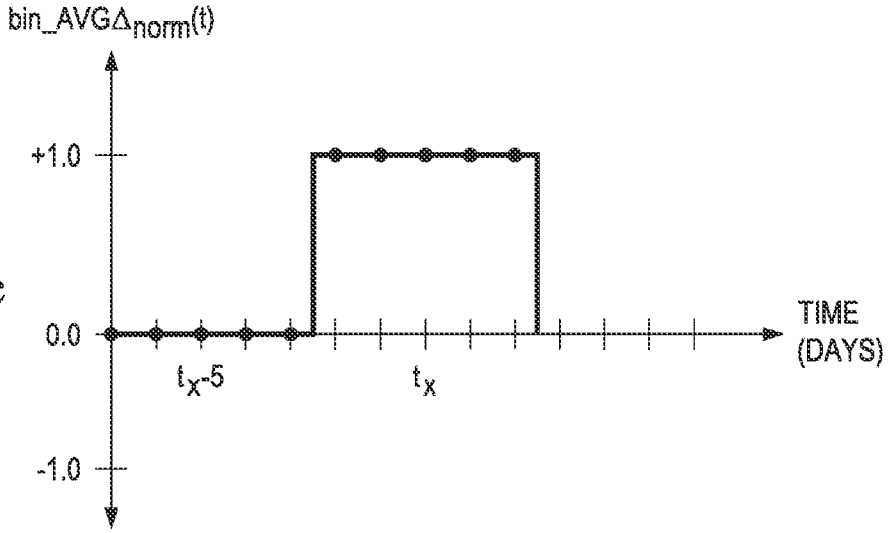

FIGS. 9*a* through 9*c* illustrate a simple example of the operation of processes 100 through 106 according to this embodiment of the invention. FIG. 9*a* illustrates an example of a time series of normalized gradient differential values $\Delta_{norm}$ for a producer $P_k$. In the example of FIG. 9*a*, a potential event corresponding to a negative change in gradient (by an amount of twice the threshold $\tau 1$, or "−2") has been identified at time $t_{x-5}$, and a potential event corresponding to a positive change in gradient (by an amount of four times the threshold $\tau 1$, or "+4") has been identified at time $t_x$. None of the other times of analysis correspond to a change in gradient exceeding threshold $\tau 1$.

FIG. 9*b* illustrates the result of process 100, in which a running average $AVG\Delta_{norm}(t)$ over five sample periods centered about each sample time (i.e., k2=5) has been calculated. As shown in FIG. 9*b*, a value of $AVG\Delta_{norm}(t)$ of −0.4 results from the averaging of the "−2" value of $\Delta_{norm}$ at time $t_{x-5}$, with that value of −0.4 spread over the five sample times for which a centered five-period average would include time $t_{x-5}$ (no other change in gradient being present within that five-period time window). Similarly, a value of $AVG\Delta_{norm}(t)$ of +0.8 results from the averaging of the "+4" value of $\Delta_{norm}$ at time $t_x$, with that value of +0.8 spread over the five sample times at which a centered five-period average would include time $t_x$ (no other change in gradient being present within that five-period time window). In the example of FIG. 9*b*, the positive and negative thresholds $+\tau 2$, $-\tau 2$ are shown, having values of +0.5, −0.5, respectively. As evident from a comparison of FIGS. 9*a* and 9*b*, the changes in gradient detected at specific sample times $t_{x-5}$, $t_x$ have been effectively spread in time to surrounding sample points. This time-spreading facilitates the detection of events, in a manner that is more heavily weighted to larger changes in gradient.

FIG. 9*c* illustrates the results of decision 101 and processes 102, 104, 106 of process 72 in this embodiment of the invention. The spread $AVG\Delta_{norm}(t)$ values of −0.4 surrounding time $t_{x-5}$ each fall short of negative threshold $-\tau 2$ (which is −0.5 in this example), and as such process 102 is applied to each of those sample points, setting those values to "0". But because the time-spread $AVG\Delta_{norm}(t)$ values of +0.8 surrounding time $t_x$ exceed positive threshold $+\tau 2$ (+0.5 in this example), process 104 is performed to set a "+1" value for each of those sample times, as shown in FIG. 9*c*. This thresholding by decision 101 according to this embodiment of the invention thus serves to filter lesser changes in gradient in the measurement data, while preserving the time-spreading effect useful in detecting the presence of events, as will be described in further detail below.

Referring again to FIG. 7, decision 107 determines whether additional time points along the time series of normalized gradient differential values $\Delta_{norm}$ for that producer $P_k$ remain to be processed; if so (decision 107 is "yes"), then the analysis time $t_x$ is advanced (process 108) and the next running average is calculated. If not (decision 107 is "no"), process 72 is complete for this producer $P_k$.

While process 72 is described above as averaging and time-smoothing identified producer events, it is contemplated that similar averaging and time-smoothing may be applied to the injector events identified in process 42 described above, to facilitate the association processes described below. Other steps to facilitate the analysis may also be included at this stage of the overall process. One such additional process is a check to ensure that the recorded and retained events for a producing well do not include any such events that are a consequence of shut-in or restart at that same well, because events of this type are clearly the result of operator intervention. In the event that producer-to-producer interactions are to be analyzed, however, full shut-in and restart events at producing wells will be retained as "causal" events (the response at other producers being of interest), but not as "response events". In addition, any identified events occurring at a well during shut-in may be filtered out at this time.

Upon completion of process 72 (FIG. 6), optional process 73 may be performed to further facilitate the identification of producer events. In process 73, system 20 operates to "jitter" the producer events detected in process 72 in time. As known in the graphics processing art, the jittering of images can serve to improve the fidelity of an edge of a displayed image, essentially by eliminating the effects of pixelization (i.e., errors due to sampling) in the displayed image. Similarly, time jittering of the detected events in the time series resulting from process 72 can reduce the possibility that subsequent event identification and causation analysis will miss a true producer event due to an injector event, due to a rounding error etc. According to this embodiment of the invention, jitter process 73 may be performed simply by creating additional time series of detected events (e.g., digital representations containing data corresponding to the signed binary result shown in FIG. 9*c*), with each additional time series time-shifting the events by some selected jitter time (e.g., on the order of one sample period) in either direction. Each of the additional time series, along with the original result, can then be processed in the manner described below.

Following jitter process 73 (if performed), the potential producer events detected by processes 70, 72 according to this embodiment of the invention are ready for causal analysis relative to potential injector events. As shown in FIG. 6, the candidate injector events identified in process 42 are retrieved in process 74, along with any attributes determined in process 42. As mentioned above, these attributes may include such information, for each injector or injector event, such as delay times observed by the user or by system 20 between the injector event and potential producer events resembling the injector event (e.g., as identified in visualizations such as shown in FIG. 5*d*). The identities of those producers P1 through P7 identified as having similar corresponding events may also be retrieved, if desired. In process 76, system 20 selects for analysis a range of delay times, relative to injector events, within which producer events are expected to occur (if at all). Process 76 may be derived by system 20 automatically from delay time attributes detected in process 42 and retrieved in process 74. Alternatively, a user of system 20 may input or adjust the range of delay times to be analyzed based on an enhanced visualization focusing on isolated events and intermediate injection event free periods, as described above; such a visualization can reveal the time periods of inter-well communication by plotting adjacent time-lines of the injection and production data.

The precise size and timing of events identified in the producer wells' time series data is sensitive to the choice of parameters used. Effective default values for the parameters can be derived based on the intrinsic values and variability of the time series data itself. However, it has been recognized, in connection with this invention, that one can validly vary the parameters across a range of reasonable values. According to an alternative implementation of this invention, the process can be carried out over a number of scenarios exploring the full matrix of ranges of reasonable values for all the parameters, with the set of results over these scenarios post-processed to eliminate those scenarios that clearly result in infeasible numbers of events (i.e., events at the level of "noise" in the process data are being resolved). The post-processed results can then be managed as an ensemble of models of events to locate isolated events in the manner described above for the injection wells, while the injection data is analyzed in a similar manner to that described above for the producer data. Alternatively, an ensemble of counting scores can be generated, as will be described below.

Upon retrieval of both the producer events (process 72) and injector events (process 74), system 20 next executes process 78 to identify those producer events that are within the selected range of causal delays of each of the injector events. It is contemplated that various approaches to identifying paired injector-producer events within the range of causal delay times, and attributes of those paired injector-producer events, can be utilized in connection with this invention.

One such approach suitable for use in connection with embodiments of this invention is described in U.S. Pat. No. 7,890,200, issued Feb. 15, 2011, entitled "Process-Related Systems and Methods", commonly assigned herewith and incorporated herein by reference, in its entirety. According to this approach, the processed injector measurement time series and the time-smoothed thresholded producer events identified in process 72 are considered as process variables having values varying over time. Causal relationships among those process variables are identified by the process of U.S. Pat. No. 7,890,200, with the assistance of the indication of the injector events as cause events, and the corresponding producer events as the corresponding response events. As described in this U.S. Pat. No. 7,890,200, confidence levels for the identified pairs of injector-producer events are calculated, along with such other statistical attributes as may be useful in the remainder of process 44 of FIG. 6.

Figure 10:
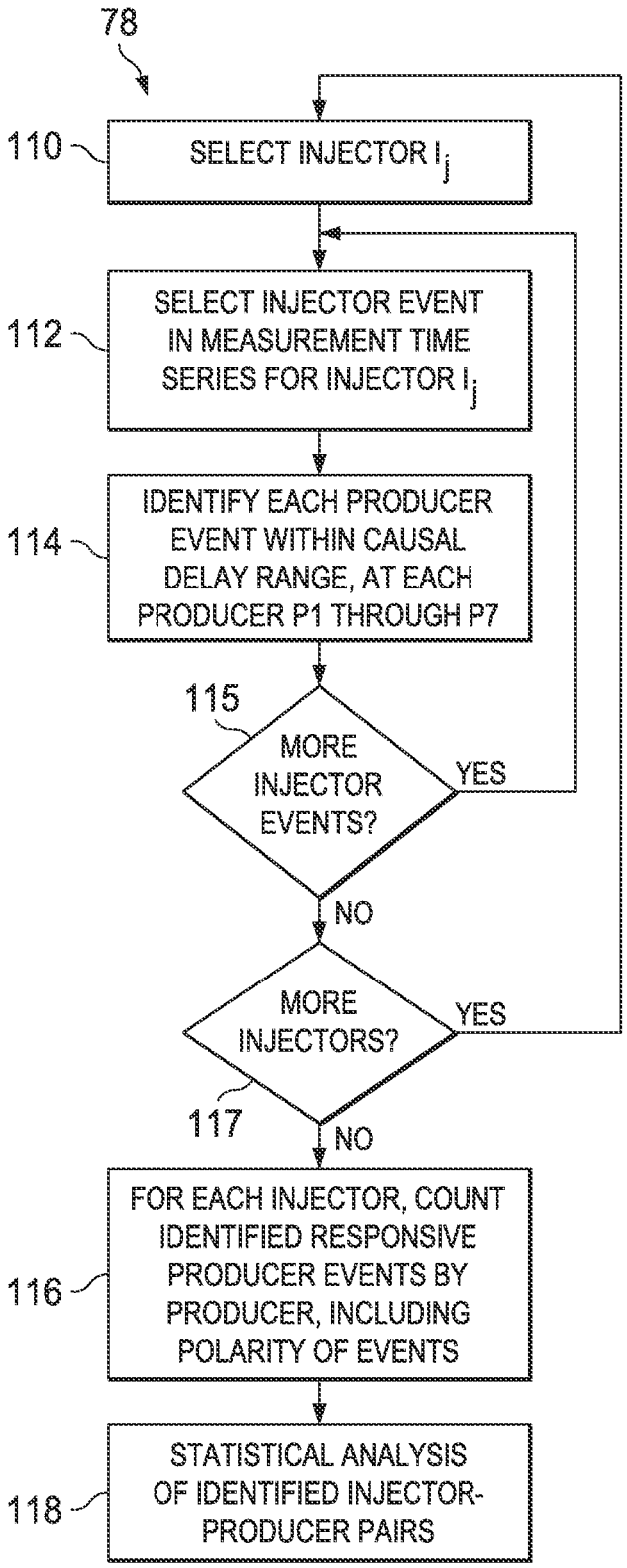
FIG. 10 is a flow diagram illustrating a method of detecting causal relationships between injector and producer events, according to the embodiment shown in FIG. 6.

A generalized counting approach for identifying injector-producer relationships in process 78 will now be described with reference to FIG. 10, beginning with the selection of an injector $I_j$ for analysis, in process 110. In this description, each of injectors I1 through I5 of production field 6 under analysis will be interrogated sequentially, although it is to be understood that such data analysis may be parallelized as desired. In process 112, an injector event in the measurement data time series for selected injector $I_j$ is selected; alternatively, if the averaging, time-smoothing, or other filtering of process 72 is applied to injector events, the time series of injector events will correspond to the result of such processing. These injector events may be either an increase in injection flow, or a decrease in injection flow. Once a particular injector event is selected in process 112, the time series of event indicators produced in process 72 for each of producers P1 through P7 are then analyzed in process 114, over the causal delay range selected in process 76 to identify producer events (of either positive "+1" or negative "−1" polarity) occurring within that causal delay range that match the injector event. Decision 115 is then executed by system 20 to determine whether additional injector events for the selected injector $I_j$ remain to be analyzed; if so (decision 115 is "yes"), another injector event is selected in process 112, and process 114 is repeated. Upon completion of analysis for all injector events for the currently selected injector $I_j$ (decision 115 is "no"), system 20 next executes decision 117 to determine whether additional injectors remain to be analyzed. If so (decision 117 is "yes"), processes 110, 112, 114, and decision 115 are then repeated for a next injector.

Upon completion of the identification processes for all injectors (decision 117 is "no"), process 116 is next executed by system 20 to count the identified producer events from process 114, by each injector-producer pair. The resulting counts can include such values, for each injector-producer pair ($I_j$, $P_k$), as:

- number of causal events at injector $I_j$
- number of response events at producer $P_k$ in response to causal events at injector $I_j$
- numbers of causal events at injector $I_j$ without responses at producer $P_k$, and of response events at producer $P_k$ to other events at different injectors
- numbers of positive (increased flow) response events, and of negative (decreased flow) response events at producer $P_k$ in response to positive (increased flow) causal events at injector $I_j$
- numbers of positive (increased flow) response events, and of negative (decreased flow) response events at producer $P_k$ in response to negative (decreased flow) causal events at injector $I_j$ and the like.

Following count process 116, system 20 executes statistical analysis process 118, to provide various statistical measures relating to the producer-injector pair responses identified in process 114. The various statistical measures calculated in process 118 can include one or more of the following:

- support (and support percentage) of producer $P_k$ response assigned to causal events at injector $I_j$
- confidence level that the association exists
- chi-squared parameters pertaining to the association
- an overall "score" or figure of merit for the strength of the association
- statistics of surprise for the association and the like. It is contemplated that those skilled in the art, having reference to this specification, will be readily able to select and apply those statistical measures found to be useful in evaluating the strength of the identified injector-producer associations, depending on the particular production field 6 and experience in secondary recovery analysis according to embodiments of this invention, and otherwise.

Other operations may additionally be included within identification process 78 executed by system 20, according to embodiments of this invention. As mentioned above, the gradient analysis used to identify producer events, in process 42, provides the benefit of filtering first-order, "intra-well", effects from appearing as possible producer events caused by injection. These first-order effects tend to be removed from analysis, and do not appear as significant changes in production or in the other attribute being analyzed. However, in actuality, it is possible that a true response at a producing well to an injection event may be occurring at the same time as an intra-well effect, due to a change in gas lift, change in choke valve position, etc. In that event, the true response to the injection event would also be filtered out with the intra-well effect, masking the true producer response. It is therefore contemplated, in connection with this invention, that process 78 may include the insertion of a synthetic injector-producer event at an averaged delay time. For example, either or both of the counts in process 114 and the statistics evaluated in process 118 may indicate a well-behaved causal relationship for those events for an injector-producer pair, but a producer event may not be identified at the expected delay time for a particular injector event, due to some action (e.g., increase in gas lift) at the producing well itself. The insertion of a synthetic "event" an estimated magnitude in process 78 can compensate for the masking of the true producer event by such a first-order effect, compensating for degradation in the association statistic due to the presence of the first-order intra-well effect.

In addition, process 78 may also identify producer-producer associations, in which a flow output change event at one producer $P_k$ is determined to be strongly associated with a flow output change event at a different producer $P_m$, rather than in response to an injector event. Knowledge of such producer-producer associations may be analyzed by system 20 to further characterize the reservoir; alternatively, system 20 and its user may downgrade or wholly ignore events caused by producer-producer associations, if the goal of the overall process is to evaluate potential injection actions on the output of production field 6 in isolation from inter-producer effects.

Figure 11A:
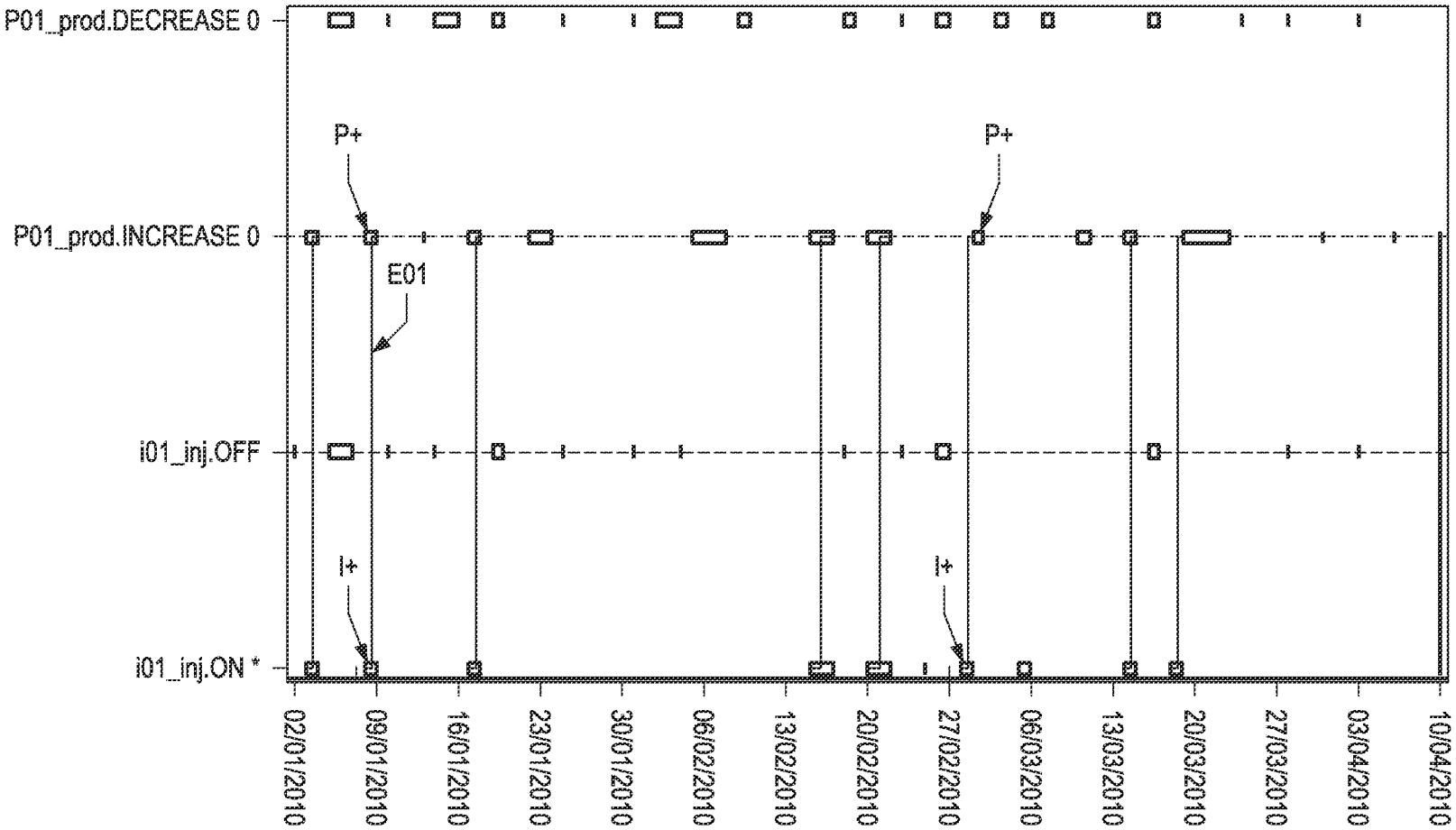
FIGS. 11*a* and 11*b* are visualizations of an example of detected causal events resulting from the method of FIG. 10, according to that embodiment.
Figure 11B:
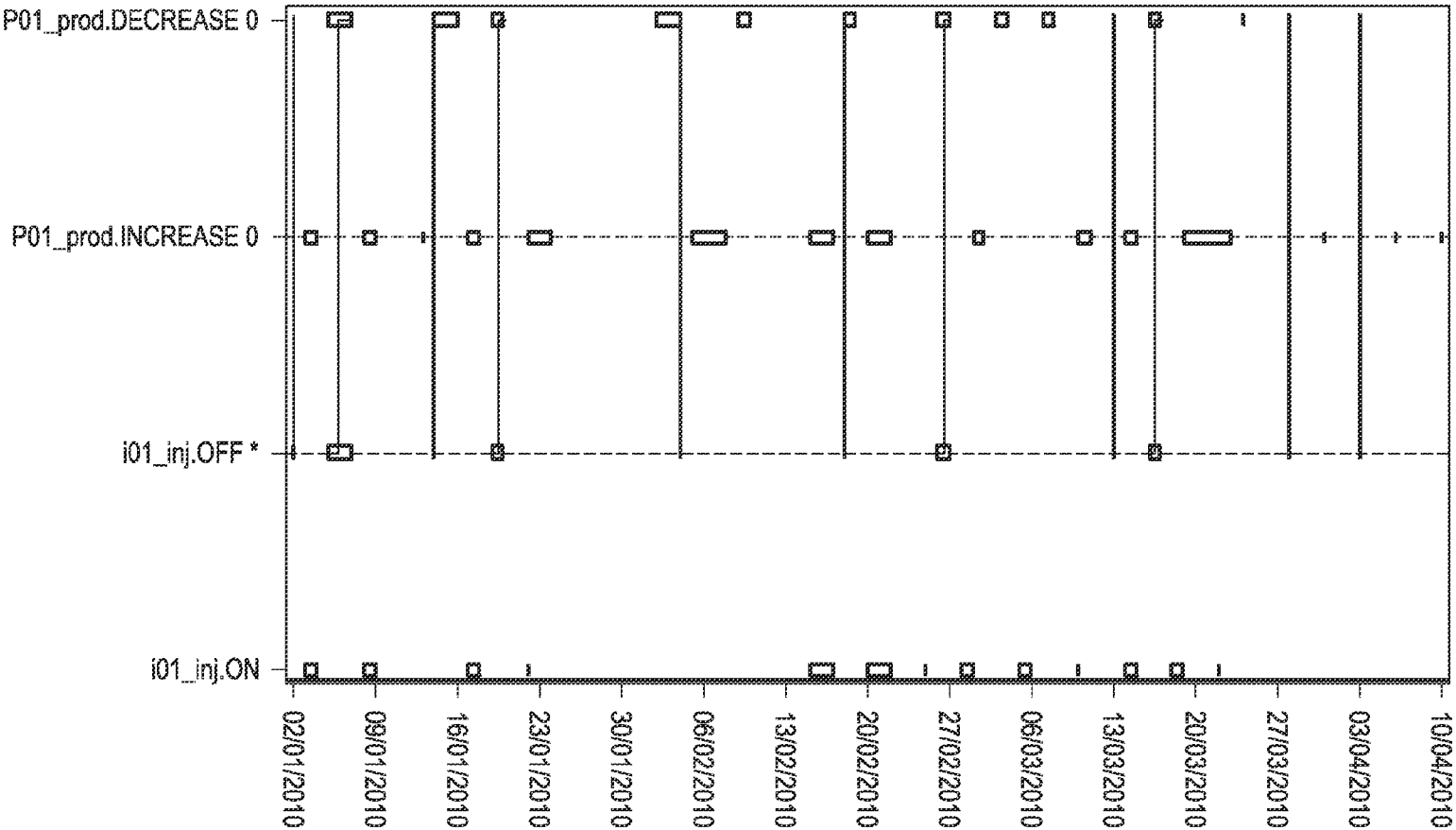

As shown in FIG. 6, in process 81, system 20 may optionally display a visualization of the injector-producer events identified in process 78. FIGS. 11*a* and 11*b* illustrate examples of such visualizations. Each of FIGS. 11*a* and 11*b* present (from bottom to top) time series indications of the events: injector I1 being turned on ("I01_inj.ON"), injector I1 being turned off ("I01_inj.OFF"), production increase at producer P1 ("P01_prod.INCREASE"), and production decrease at producer P1 ("P01_prod.DECREASE"). The presence of an event along each of these time series is indicated by a rectangle, with the length of the rectangle corresponding to the duration of the event. FIG. 11*a* illustrates identified associations between increased injection events ("I+") at injector I1 and increased production events ("P+") at producer P1 by the vertical lines (e.g., association E01) connecting the events. These indications of events may also optionally include a visualization of the strength of the event by color or shading. FIG. 11*b* illustrates the same four time series of injector I1 and producer P1 events, with associations between events of injector I1 being turned off and decreased production events at producer P1 indicated by vertical lines. Again, decreased production events associated with other injector events are indicated in FIG. 11*b* by vertical lines that are unconnected to an injector I1 event. These visualizations as displayed in process 81 enable the user of system 20 to visually check the identified associations; it is contemplated that the user may also interact with these visualizations, for example to confirm or reject particular associations.

Referring back to FIG. 6, process 80 is now performed by system 20 to determine a strength-of-association measure for each injector-producer pair. The number of injector-producer pairs will, of course, amount to the product of the number of injectors with the number of producers (e.g., for production field 6 of FIG. 1, five injectors I1 through I5 and seven producers P1 through P7 yield thirty-five injector-producer pairs).

Figure 12:
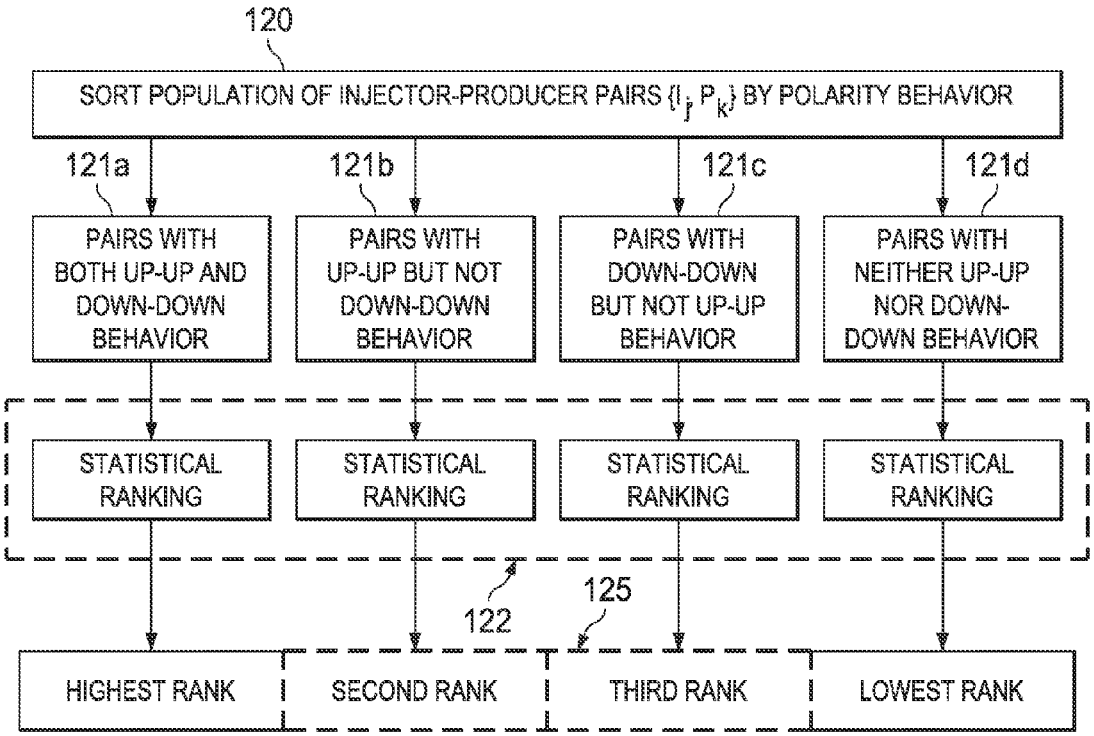
FIG. 12 is a flow diagram illustrating a method of rank-ordering detected injector-producer pairs, according to the embodiment shown in FIG. 6.

An example of rank ordering process 80 according to an embodiment of this invention is illustrated in FIG. 12. In this example, the population of injector-producer pairs $\{I_j, P_k\}$ is first sorted according to their polarity behavior, evaluating the polarity of effects at producer $P_k$ in response to events at injector $I_j$ of both polarities. First group 121*a* of injector-producer pairs $\{I_j, P_k\}$ includes those for which producer $P_k$ exhibits increased production flow events in response to increased injection events at injector $I_j$, and also exhibits decreased production flow events in response to decreased injection events at injector $I_j$ (i.e., both "up-up" and "down-down" behavior). Second group 121*b* includes those injector-producer pairs $\{I_j, P_k\}$ for which producer $P_k$ exhibits increased production flow events in response to increased injection events at injector $I_j$, but which do not exhibit decreased production flow events in response to decreased injection events at injector $I_j$ (i.e., "up-up" but not "down-down" behavior). Third group 121*c* of injector-producer pairs $\{I_j, P_k\}$ includes those pairs for which producer $P_k$ exhibits decreased production flow events in response to decreased injection events at injector $I_j$, but which do not exhibit increased production flow events in response to increased injection events at injector $I_j$ (i.e., "down-down" but not "up-up" behavior). Final group 121*d* includes those injector-producer pairs $\{I_j, P_k\}$ that exhibit neither increased production flow events in response to increased injection events at injector $I_j$ nor decreased production flow events in response to decreased injection events at injector $I_j$. Statistical ranking process 122 is then applied within each group 121*a* through 121*d*. It is contemplated that the statistics used to carry out such ranking will include the confidence level that an association exists between injector $I_j$ and producer $P_k$, and support for producer events at producer $P_k$ attributed to injector $I_j$; other statistics may alternatively or additionally be used as appropriate. Statistical ranking processes 122 sort injector-producer pairs $\{I_j, P_k\}$ within groups 121 of rank-ordered list 125, according to their strength of association. As evident from FIG. 12, rank-ordered list 125 orders injector-producer pairs $\{I_j, P_k\}$ first according to their polarity response (i.e., according to groups 121*a* through 121*d*, with group 121*a* occupying the top-ranked portion of list 125, group 121*b* the second-ranked portion, etc.), and with the results of statistical ranking process 122 ranking the individual injector-producer pairs $\{I_j, P_k\}$ within each of those portions of list 125. As mentioned above, other ranking approaches and techniques may alternatively or additionally be used. For example, the user or operator of production field 6 may be aware of information that may be incorporated into other exclusion principals, for example based on geography or geology, that can be used to remove particular injector-producer associations from rank-ordered list 125, regardless of the statistical results.

Following rank ordering process 82 (FIG. 6), detection process 44 in the overall process flow shown in FIG. 3 is completed, according to this embodiment of the invention. Detection process 44 thus accomplishes the task of analyzing historical and current producer measurement data pertinent to output flow rates at producing wells P1 through P7 in production field 6 of interest, such measurement data being direct flow rate measurements, allocated flow rates from commingled output measurement, calculated flow rates based on indirect measurements at the well (e.g., pressure and temperature), or another measured parameter such as bottomhole pressure. From that analysis, process 44 has detected events at those producers P1 through P7, considered the responsiveness of those production events to events at injection wells I1 through I5 in production field 6, and arranged an ordering of the possible injector-producer pairs according to the strength of their behavioral association. According to embodiments of this invention, those injector-producer associations are iteratively applied to a reservoir model in process 46, in an ordered manner according to the result of process 44, to efficiently obtain a working model of the reservoir that can be used to evaluate continued and potential secondary recovery actions.

According to embodiments of the invention, the well-known "capacitance model", or "capacitance-resistivity model" ("CRM"), is constructed using the associations derived in process 44. To summarize, the CRM typically models the cumulative production output q(t) of a given well over time, assuming a pseudo-steady-state condition, as the sum of a primary exponential term, a sum of the effects of injection wells in the same production field, and a term reflecting variations in bottomhole pressure (BHP). A typical expression of the CRM equations is given by Sayarpour et al., "The Use of Capacitance-resistivity Models for Rapid Estimation of Waterflood Performance and Optimization", SPE 110081, presented at the 2007 SPE Annual Technical Conference and Exhibition (2007), incorporated herein, in its entirety:

$$q(t) = q(t_0)e^{-\left(\frac{t-t_0}{\tau}\right)} + I(t)\left(1 - e^{-\left(\frac{t-t_0}{\tau}\right)}\right) - (c_t V_p)\left[\frac{p_{wf,t} - p_{wf,0}}{t - t_0}\right]\left(1 - e^{-\left(\frac{t-t_0}{\tau}\right)}\right)$$

where $t_0$ is an initial time, t is a time constant, I(t) reflects an injection flow rate over time as it affects the particular producing well, $c_t$ is a compressibility at the well, $V_p$ is the pore volume at the well, and the $p_{wf}$ values are bottomhole pressures. In evaluating the effect of a measured injection flow rate at an injector well on the cumulative production q(t) at a producing well, as reflected in the I(t) value in the CRM equation, the three parameters of gain (i.e., the connectivity of an injector $I_j$ to the well), a time constant of the injection relationship between injector $I_j$ to the well, and a productivity constant reflecting the drive of the reservoir as it relates to the relationship of injector $I_j$ and the well, must be evaluated for each of the injectors I1 through I5 in production field 6. This evaluation is applied to each of producers P1 through P7, in order to model the entire production field 6. Typically, derivation of a CRM for a given production field involves solution of an optimization problem, given injection flow rates and production flow rates, to minimize the absolute error at each of the producers; the optimization will then yield the desired parameters (i.e., gain, time constant, productivity constant) for each of the injector-producer pairs in the production field, yielding a model useful in evaluating secondary recovery.

Conventional CRM optimization is an over-parameterized problem, however. As such, the computational effort and resources required to converge on a reasonable estimate of the model can be substantial. According to embodiments of this invention, however, the derivation and evaluation of a useful CRM reservoir model can be done efficiently, with reasonable computational effort and resources.

Figure 13:
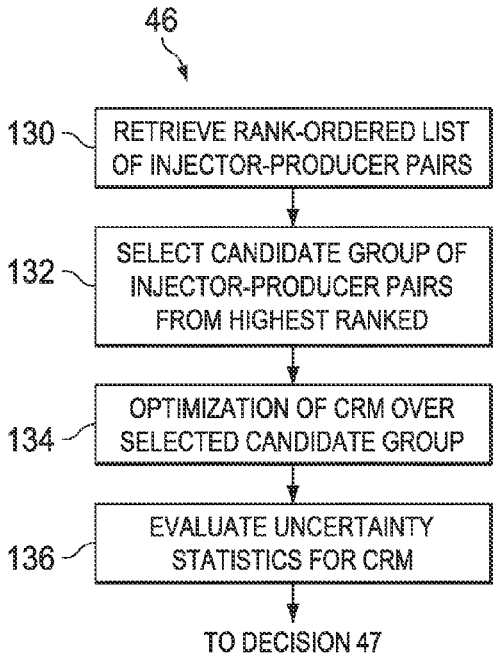
FIG. 13 is a flow diagram illustrating a method of evaluating a capacitance-resistivity model (CRM) with a subset of the identified injector-producer associations, according to the embodiment shown in FIG. 6.

Referring now to FIGS. 13, 14*a*, and 14*b*, an example of the operations executed by system 20 in process 46 will now be described in detail. As shown in FIG. 13, process 130 retrieves rank-ordered list 125 of injector-producer pairs generated in process 44, based on the observed event associations from the measurement data and the corresponding statistical analysis of those associations. In this embodiment of the invention, a candidate group of injector-producer pairs to be applied to a first pass of deriving the CRM for production field 6 is then selected, in process 132. In this first pass of process 132, this selected candidate group of injector-producer pairs includes the strongest associations from rank-ordered list 125, excluding those of weaker association. The particular selection of process 132 may be performed in an interactive manner by the user of system 20, perhaps in addition with guidance from system 20 in its grouping of injector-producer pairs according to "strong", "medium", "weak", and "no" associations.

FIGS. 14*a* and 14*b* illustrate an example of an upper portion of rank-ordered list 125 for injectors I1 through I5 and producers P1 through P7 of production field 6 of FIG. 1. In this example, FIG. 14*a* illustrates the rank-ordering of associations based on increased producer flow rate in response to increases in injection, and FIG. 14*b* illustrates the rank-ordering of associations based on decreased producer flow rate in response to decreases in injection. It is contemplated that the particular selection of associations for application to the CRM may be made separately (e.g., a selected injector-producer pair may reflect only the increasing relationship and not the decreasing relationship), or both relationships may be used to select an injector-producer pair. As shown in FIGS. 14*a* and 14*b*, the particular injector-producer associations are grouped according to "STRONG", "MEDIUM", and "WEAK" association groups. Each association includes an identification of the injector and producer, along with the confidence level of that association, and an indication of the support of the change in the producer flow attributed to that injector. In this example, the relationship between injector I1 and producer P1 is a particularly strong relationship, with the highest confidence level and support in each of the lists of FIGS. 14*a* and 14*b*. It is contemplated that the number of injector-producer pairs in each of the "STRONG", "MEDIUM", and "WEAK" association groups is not fixed from field to field or from time to time. Indeed, it is contemplated that these groups can be identified by relying on relatively large gaps in confidence or support values to conveniently break out the various groups. Other approaches for assigning the strength of associations may be utilized, examples of which include strong visual pairings among the subset of isolated events, use of extrinsic information pertaining to geology, etc.

Referring back to FIG. 13, therefore, the first pass of process 132 may thus select the "STRONG" associations present in rank-ordered list 125 of injector-producer pairs. Those injector-producer pairs are then used in optimization of a CRM for the production field in process 134, performed by system 20 according to conventional CRM optimization techniques and algorithms. CRM parameters for other injector-producer pairs reflect zero connectivity in process 134. Upon completion of CRM optimization process 134, system 20 then evaluates one or more uncertainty statistics for the optimized CRM parameters in process 136, for the values of the parameters obtained in this most recent pass of optimization process 134. The evaluated uncertainty statistics are contemplated to be conventional measures of uncertainty, for example the standard error of the parameter values. This first instance of process 46 (FIG. 3) is then complete.

Referring back to FIG. 3, because this is the first instance of process 46, the result of decision 47 performed by system 20 necessarily returns a "yes" result. Process 46 is then repeated with at least one additional injector-producer association. In the detailed flow diagram of FIG. 13, in this next pass, process 132 selects one or more association from rank-ordered list 125 for application to optimization process 134. For example, if the entire "STRONG" group of associations (FIGS. 14*a*, 14*b*) was applied in the first pass of process 134, at least one association from the "MEDIUM" group (i.e., the top-ranked injector-producer pair in that group) will be selected in this next instance of process 46. This additional association may be a single association, the entire "MEDIUM" group, or some subset of that group. Optimization process 134 is then repeated with the additional association or associations, and one or more uncertainty statistics are then again evaluated for this next pass of optimization process 134, completing this instance of process 46 with the increased number of associations.

For this second (and subsequent) instances of process 46, the uncertainty statistics calculated in process 136 are compared with the values of those uncertainty statistics calculated in the most recent previous pass of process 46. Decision 47 is performed by process 20 to evaluate whether the fit of the model has improved to a statistically significant extent. For example, the well-known Student's t-test may be applied to determine, from the standard error or other uncertainty statistics calculated in the two most recent evaluations of the model, whether the distribution of the model parameters evaluated in that instance of process 136 (i.e., with the additional associations) is equal to the distribution of model parameters from the previous instance, to a selected statistical significance. For example, decision 47 may evaluate this statistical similarity using a selected threshold level of p-value (probability that a selected statistic from the most recent parameter distribution is at least as extreme as that statistic from the prior distribution, if the distributions are equal), with the test statistic being standard error of the model parameters. Of course, other tests of statistical significance regarding the difference in the two sets of model parameters may be used. The particular threshold level may be selected by the user a priori, or may be selected during the overall process based on previous values of the uncertainty statistics for the particular production field 6. If the uncertainty statistic of the evaluated CRM parameters reflects a statistically significant better fit (e.g., less standard error) in the most recent pass of process 46 with the additional one or more injector-producer associations (decision 47 is "yes"), process 46 is repeated again, including the addition of one or more injector-producer associations according to rank-ordered list 125. On the other hand, if the most recent pass of process 46 did not improve the uncertainty statistic in the CRM parameters from optimization process 46 to the selected statistical significance (decision 47 is "no"), then derivation of the CRM model is considered complete. Inclusion of additional injector-producer associations would not serve to improve the optimization of the CRM parameters, to any statistical significance. The values of model parameters from the most recent pass of process 46 (or from the prior pass of process 46, if desired), are then used in subsequent evaluation of the CRM.

According to embodiments of this invention, therefore, the difficulties in deriving a model of the injector and producer relationships in a production field from measurement data pertaining to flow rates are avoided in large part. In particular, the difficulty in deriving a CRM model due to over-parameterization, especially as applied to production fields containing even a reasonable number of injection wells and production wells, is largely avoided. Only those injector-producer connections that appreciably affect the CRM model, to any significant statistical degree, need be included in the optimization of the model parameters. This efficient construction of the model is based on actual measurement data and automated identification of events, and allows for rapid re-evaluation of the models with recently obtained measurement data. In addition, this derivation and evaluation of the secondary recovery model can be readily scaled to large production fields, with a large number of injectors and producers, without overwhelming the available computing resources, because of its hierarchical application of the strongest injector-producer associations according to statistical measures of those associations.

Referring back to FIG. 3, therefore, the resulting model with its evaluated model parameters can then be used to analyze prospective secondary recovery actions. A proposed increase or change in fluid injection flow at one or more injection wells in the production field under analysis can be applied to the model, and the effect of that proposed change on production can be readily evaluated. Examples of conventional techniques to optimize secondary recovery actions by evaluation of CRM and similar reservoir models are described in Liang et al., "Optimization of Oil Production Based on a Capacitance Model of Production and Injection Rates", SPE 107713, presented at the 2007 SPE Hydrocarbon Economics and Evaluation Symposium (2007); Sayarpour et al., "The Use of Capacitance-resistivity Models for Rapid Estimation of Waterflood Performance and Optimization", SPE 110081, presented at the 2007 SPE Annual Technical Conference and Exhibition (2007); both incorporated herein by reference in their entirety. A connectivity model for the reservoir, as provided by embodiments of this invention, can then be used to efficiently evaluate secondary recovery actions, by trial-and-error, or by an additional optimization process (e.g., minimization of a cost function), or by some other technique, to maximize oil and gas production via secondary recovery activities, at minimum cost.

The processes involved in deriving a statistical reservoir model, according to embodiments of this invention, may also enable additional analysis and experimental design, in addition to the evaluation of potential secondary recovery actions. For example, the statistics underlying the rank-ordered list of injector-producer associations produced according to this invention may be separately analyzed to design optimization experiments. According to this approach, those injector-producer associations that appear to be strongly linked (e.g., strong support) but that exhibit a weak confidence in that strong association may be specifically tested, by intentionally causing injection events at that injector while holding other injectors constant, and closely monitoring the response at the producer; evaluation of the injector-producer interaction from those experiments can be used to further refine the actual strength of that association. According to other uses of embodiments of this invention, candidate wells for sweep modification, such as by way of the injection of water with the BRIGHT WATER dispersion product available from TIORCO, may be identified from analysis according to embodiments of this invention. The optimization of secondary recovery actions according to embodiments of this invention may also incorporate economic cost factors, for example by assigning an economic value of the injected water, and evaluating the barrels of oil produced from such injection at particular price levels, to arrive at an economic optimization of those secondary recovery actions. These and other uses are contemplated to be within the scope of this invention.

Capacitance-Resistivity Model (CRM) Evaluation Before Event Detection

Figure 15:
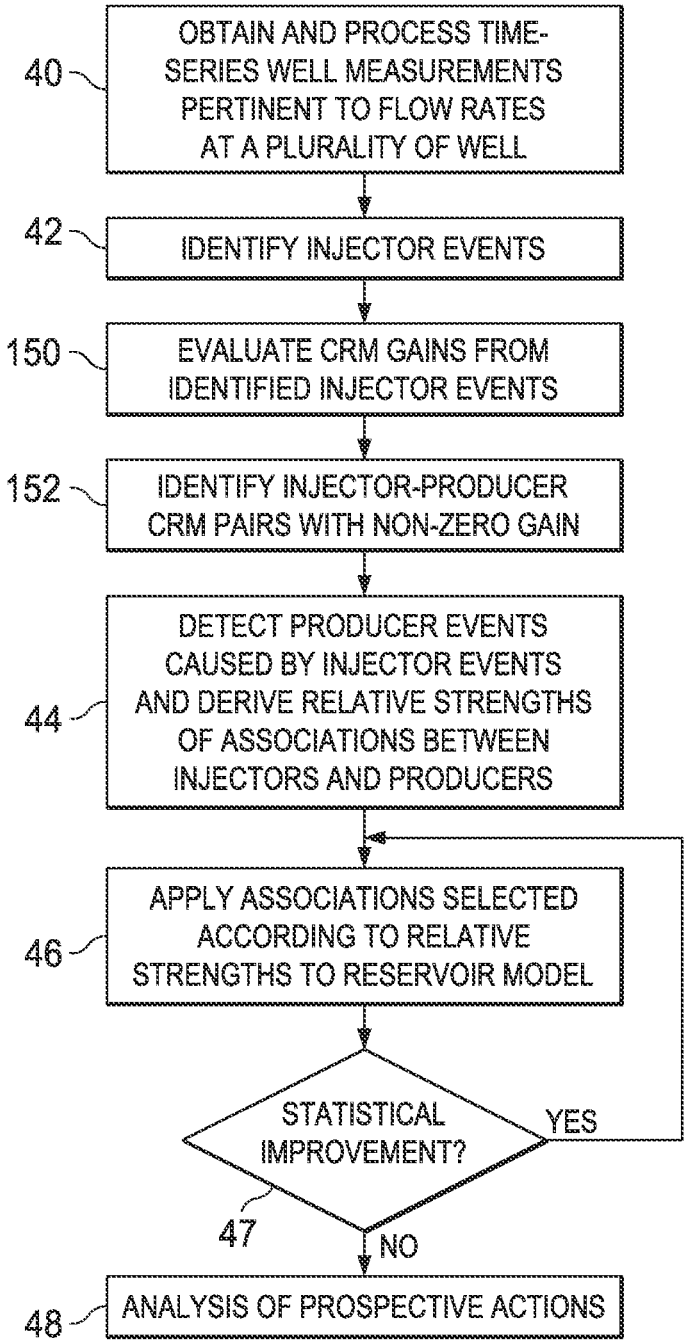
FIG. 15 is a flow diagram illustrating the operation of the computer system of FIG. 2 according to an alternative embodiment.

According to another embodiment of the invention, evaluation of a reservoir model is performed prior to detection of injector-producer events. FIG. 15 is a flow diagram illustrating an example of this embodiment of the invention; similar processes in this embodiment as in the embodiment described above relative to FIG. 3 are identified in FIG. 15 with the same reference numerals.

The process of this embodiment of the invention begins, as before, with process 40 in which measurement data pertaining to flow rates of wells in production field 6 of interest are obtained and processed by system 20. As described above in detail relative to this process 40, these measurement data are acquired from the appropriate data source, and can include flow rate measurements or calculations of flow rates from each injector I1 through I5 and producer P1 through P7 of production field 6 over time, other well measurements such as bottomhole pressure (BHP), non-structured or non-periodic data from fluid samples, well tests, and chemistry analysis, etc. Process 40 also applies various filtering, processing, and editing of these measurement data as described above, for example to remove invalid values and statistical outliers, adjust or filter the data into a regular periodic form, apply corrections to "reservoir barrels" if desired, and the like.

As described above relative to FIG. 3, system 20 then identifies injector events from the processed measurement data, in process 42. The manner in which system 20 carries out event identification process 42 can follow that described above in connection with FIGS. 3, 4*a*, and 4*b*, including the correlation and visualization approaches described above. As before, injector events of various types are contemplated to be detected in this instance of process 42. These events include "on-off" injector events corresponding to injector wells being brought on-line and off-line. Injection events that occur during running operation (i.e., changes in injection flow rate at an injector that is on-line) can also be considered according to this embodiment of the invention. In addition, as described above, isolated injection events (e.g., events occurring at one injector that differ from changes at multiple other injectors, such as change in injection rate of the opposite direction) can lend particular insight into well-to-well communication. The injector events identified in process 42 thus correspond to changes in the injection flow at one or more injectors, and can also correspond to other occurrences such as changes in water-alternative-gas injection at injectors, and increases in gas production or the gas-oil ratio (GOR) at producers, as described above.

According to this embodiment of the invention, a reservoir model is evaluated prior to the event detection of injector-producer pairs, to restrict the number of injector-producer pairs requiring event detection and association study. As such, once a set of injector events has been identified in process 42, the appropriate reservoir model is evaluated to initially identify producers that potentially have some connectivity and thus response to the injector events identified in process 42. In this example, a capacitance-resistivity model (CRM) is evaluated based on those identified injector events, in process 150. As well-known in the art, conventional CRM models evaluate the effect of a measured injection flow rate at an injector well on the cumulative production q(t) at a producing well, by evaluating the three parameters of gain (i.e., the connectivity of an injector $I_j$ to the well), the time constant of the injection relationship between injector $I_j$ to the well, and the productivity constant reflecting the drive of the reservoir as it relates to the relationship of injector $I_j$ and the well. In process 150 according to this embodiment of the invention, the complete set of gains relating to one or more injector events identified in process 42 are evaluated; i.e., the gain associated with each of producers P1 through P7 in production field 6, are evaluated. It is contemplated that the extent to which convergence of the CRM optimization problem is achieved in process 150 can be relatively coarse, as compared with that expected in fully evaluating a reservoir model.

In process 152, the CRM gains evaluated in process 150 based on the identified injector events are analyzed. More specifically, those injector-producer pairs exhibiting zero gain in evaluation process 150 can be eliminated from further consideration in the process of FIG. 15 according to this embodiment of the invention. The iterative evaluation of the CRM within process 150 can be relied on to identify and confirm zero-gain pairs. In addition, system 20 (in an automated manner, or interactively with inputs from a user) can identify zero-gain injector-producer pairs based on criteria such as distance between the injector and producer in the field, the presence of other geological restrictions (i.e., extrinsic information indicating physical impossibility of a connection between an injector and producer), and the like. As a result of process 152, a set of injector-producer pairs are identified, from the CRM, as having non-zero gains and thus some level of connectivity within the reservoir. Those non-zero gain pairs are then forwarded to process 44, in which system 20 detects producer events caused by injector events from among that restricted subset.

Alternatively, process 42 may be omitted prior to CRM evaluation process 150 and analysis process 152, as the identification of injector events is not strictly required prior to evaluation of the CRM. In this alternative approach, the complete set of gains for all available injector-producer pairs determined in process 150 are analyzed in process 152, and those with zero-gain (either as explicitly determined or according to an alternative criteria) are removed from further analysis as described above.

According to this embodiment of the invention, therefore, event detection process 44 is primarily called upon to confirm or reject the injector-producer relationships identified by evaluation of a CRM in processes 150, 152, based on the level of statistical uncertainty for each of those relationships. In addition, event detection process 44 also enables explicit illustration of those gains that are statistically valid, based on the examination of producer responses to the identified injection events. These analyses by event detection process 44 can be based on both primary events (injector on-off events) and also secondary events ("running" injector events). By limiting the set of injector-producer associations that are to be examined in the event identification task executed by system 20 in process 44, that event detection is much more efficient, and is also more effective because "false positive" associations (events that are detected but that have zero-gain in the CRM model) are eliminated. Furthermore, the CRM evaluation prior to event detection assists in refining the extraction of effectively isolated events in the injection history because of that limiting of the set of associations. For example, if a number of injectors are rejected by the CRM evaluation as possible influences on a particular producer, the remaining smaller subset of influential injectors on that producer can be more effectively processed (e.g., by examining direction of change) to further improve estimates of the fundamental time delay for that well pair, which in turn improves the identification of accurate associations among the wells in the production field.

In addition, it is contemplated that the combination of CRM evaluation (processes 150, 152) with event detection (process 44) enables the development of an absolute test criterion for production event marking. For example, any injector-producer pair with non-zero gain in the CRM, at a high confidence level, should be expected to exhibit at least some event pairings in event detection process 44. As such, the selection of parameters and values used in event detection process 44 to define the production events can be made by evaluating which parameters and values improve the association scores of these high confidence well pairs.

For example, the injector-producer pairs indicated by process 150 as being connected can be analyzed within process 44 to derive an expectation of the likely number of response events at that producer well, which can guide the selection of event marking thresholds. In this approach, large on-off injector events are well-correlated in time over the production field, because all wells tend to be shut in together, and then re-opened together in order to return quickly to full production. As such, these events often lend little insight into connectivity. In one implementation, development of an event detection threshold at a given producer can utilize the limited set of pairs provided by CRM evaluation processes 150, 152 by:

First, identify and remove start/stop events in the producer flow rate time sequence;

For the injectors indicated by process 150 as linked to that producer, eliminate on/off and injection up/down events in immediately preceding time periods (i.e., within the expected delay time to the given producer);

Repeat these two steps for masking events in the producer time sequence;

Then sum the remaining elements of the linked injectors' time sequences (either binary values for events, or the magnitudes);

Assess the number of "peaks" in the summed injection flow rate time sequence; and Determine a useful threshold at which the summed injection flow rate time sequence causes a causal event in the time sequence of the given producer.

This threshold can then prove useful in event detection process 44, particularly in discerning the presence and importance of events at either the injectors or the producers.

The results of event detection process 44 are then used, as described above, to iteratively evaluate the CRM reservoir model (process 46 and decision 47), according to the relative statistical strengths of the associations. Analysis of prospective actions to be taken in the production field (process 48) is thus facilitated, in the manner described above.

It is further contemplated that other variations and alternative implementations to the embodiments of this invention, as become apparent to those skilled in the art having reference to this specification, can also be applied and are within the scope of this invention as claimed.

While the present invention has been described according to its preferred embodiments, it is of course contemplated that modifications of, and alternatives to, these embodiments, such modifications and alternatives obtaining the advantages and benefits of this invention, will be apparent to those of ordinary skill in the art having reference to this specification and its drawings. It is contemplated that such modifications and alternatives are within the scope of this invention as subsequently claimed herein.

What is claimed is:

1. A computer-implemented method of evaluating waterflood injection at a subsurface hydrocarbon reservoir into which one or more producing wells and one or more injecting wells have been drilled, comprising:

receiving measurement data over time corresponding to flow rates at one or more producing wells and one or more injecting wells;

from the received measurement data, identifying a plurality of associations between one of the producing wells and one of the injecting wells, based on time correspondence of events at the one of the injecting well and events at the one of the production wells identified in the received measurement data; each of the identified associations having a measure of strength of association;

ordering the identified associations according to a rank of the strength of association;

applying one or more of the associations with the highest ranks to a capacitance-resistivity reservoir model;

evaluating, by a processor, the capacitance-resistivity reservoir model relative to the measurement data to derive a set of model parameters and an associated uncertainty statistic;

applying a next one or more of the associations, selected according to the ordering of the associations by rank, to the capacitance-resistivity reservoir model;

evaluating, by the processor, the capacitance-resistivity reservoir model, with the applied next one or more of the associations, relative to the measurement data, to derive a set of model parameters and an associated uncertainty statistic;

repeating the applying a next one or more of the associations and evaluating the capacitance-resistivity reservoir model with the applied next one or more of the associations, until the uncertainty statistic reflects similarity of the model parameters from the most recent evaluating and the model parameters from a prior evaluating, to a selected statistical significance; and changing fluid injection flow in one of the injecting wells based on analysis of the capacitance-resistivity reservoir model.

2. The method of claim 1, further comprising, after the repeated applying and evaluating and responsive to the uncertainty statistic reflecting similarity to the selected statistical significance:

then evaluating a proposed injection at one or more of the injection wells using the capacitance-resistivity reservoir model and evaluated model parameters.

3. The method of claim 1, wherein the uncertainty statistic corresponds to a standard error of the model parameters.

4. The method of claim 1, wherein the measurement data for the producing wells corresponds to cumulative production over time.

5. The method of claim 1, wherein the measurement data comprise bottomhole pressures over time.

6. The method of claim 1, wherein the ordering comprises:

grouping the identified associations into a plurality of subsets according to correspondence of polarity of changes in measurement data between the injecting well and the producing well;

wherein a first instance of the applying applies a first subset of associations corresponding to the highest-ranked associations to the capacitance-resistivity reservoir model;

and wherein a second instance of the applying applies a second subset of associations corresponding to the next highest-ranked associations to the capacitance-resistivity reservoir model.

7. The method of claim 6, wherein the ordering further comprises:

within the highest-ranked one or more of the plurality of subsets, ordering the identified associations according to a statistical measure of strength of association.

8. The method of claim 1, wherein the ordering comprises:

ordering the identified associations according to a statistical measure of strength of association.

9. The method of claim 1, further comprising:

from the measurement data corresponding to flow rates at the one or more injecting wells, identifying injector events at which a change of flow rate occurred;

from the measurement data corresponding to flow rates at the one or more producing wells, detecting one or more producer events at which a change of flow rate occurred;

identifying detected producer events that occur within a selected range of delay times from identified injector events; and from the identified detected producer events, deriving associations between one of the injecting wells and one of the producing wells.

10. The method of claim 9, wherein the identifying detected producer events comprises, for each of the one or more producing wells:

calculating a gradient in the measurement data at each of a plurality of time points; and detecting time points at which the calculated gradient changes from one time point to another by greater than a first threshold value.

11. The method of claim 10, wherein calculating a gradient at a time point calculates a back gradient of the measurement data and a corresponding measure of fit over a selected number of time points including time points prior to the time point;

and wherein the detecting comprises, for each of the plurality of time points:

comparing the measure of fit at the time point with the measure of fit at a prior time point;

responsive to the measure of fit at the time point being degraded from the measure of fit at the prior time point by a selected margin, calculating a forward gradient in the measurement data at the time point over a selected number of time points later than the time point; and identifying a producer event at the time point responsive to the forward gradient differing from the back gradient by more than the first threshold value.

12. The method of claim 11, wherein the identifying a producer event further comprises:

calculating a magnitude value for the difference between the forward gradient and the back gradient at the time point.

13. The method of claim 12, wherein the identifying detected producer events further comprises:

after the detecting time points at which the calculated gradient changes from one time point, calculating a running average of the magnitude value within a selected time window that moves along a selected time period of the measurement data;

then identifying a producer event at each group of contiguous times at which the running average of the magnitude value exceeds a second threshold value; and assigning a signed indicator unit value at each time point corresponding to an identified producer event, the sign of the signed indicator unit value corresponding to the polarity of change in gradient of the identified producer event.

14. The method of claim 9, further comprising:

from the identified detected producer events, deriving associations between one of the injecting wells and one of the producing wells;

assigning an indicator to one or more of the derived associations indicating the strength of the association between the associated injecting well and producing well.

15. The method of claim 9, wherein the identifying injector events comprises:

displaying a time series of measurement data for a selected injecting well at a display of a computer system;

operating the computer system to identify one or more potential injector events in the time series;

receiving a user input selecting one of the potential injector events;

for the selected potential injector event, displaying a portion of the time series of measurement data for the selected injecting well in combination with a portion of the time series of measurement data for a selected producing well at the display, normalized in time and amplitude to align in time with one another; and after the displaying of the portion of the time series, receiving a user input confirming the selected potential injector event.

16. The method of claim 9, wherein the identifying injector events comprises:

displaying a time series of measurement data for a selected injecting well at a display of a computer system;

receiving a user input indicating a potential injector event in the displayed time series;

operating the computer system to identify one or more potential injector events similar to the indicated potential injector event, and to identify, to a user, one or more of the potential events that are functionally isolated from intra-well effects;

receiving a user input selecting one of the potential injector events;

for the selected potential injector event, displaying a portion of the time series of measurement data for the selected injecting well in combination with a portion of the time series of measurement data for a selected producing well at the display, normalized in time and amplitude to align in time with one another; and after the displaying of the portion of the time series, receiving a user input confirming the selected potential injector event.

17. The method of claim 9, further comprising:

after the identifying injector events, and before the detecting one or more producer events, evaluating a capacitance-resistivity reservoir model relative to the measurement data to derive gain values for each injector-producer pair; and defining a subset of one or more injector-producer pairs having non-zero gain values;

wherein the identifying detected producer events and deriving associations are performed over the defined subset of one or more injector-producer pairs.

18. The method of claim 1, further comprising:

correcting the received measurement data based on variations in independent flow measurement values at the well.

19. A computer-implemented method of detecting flow rate change events for a well into a hydrocarbon reservoir, comprising:

receiving measurement data over time corresponding to flow rates at the well; and at each of a plurality of time points for which measurement data are present:

calculating, by a processor, a back gradient of the measurement data and a corresponding measure of fit over a selected number of time points including time points prior to the time point;

comparing the measure of fit at the time point with the measure of fit at a prior time point;

responsive to the measure of fit at the time point being degraded from the measure of fit at the prior time point by a selected margin, calculating a forward gradient in the measurement data at the time point over a selected number of time points later than the time point;

identifying a flow rate change event at the time point responsive to the forward gradient differing from the back gradient by more than a first threshold value; and updating a capacitance-resistivity reservoir model based on the flow rate change event;

and changing fluid injection flow in an injection well based on analysis of the capacitance-resistivity reservoir model.

20. The method of claim 19, wherein the identifying a low rate change event further comprises:

calculating a magnitude value for the difference between the forward gradient and the back gradient at the time point.

21. The method of claim 20, further comprising:

after the detecting time points at which the calculated gradient changes from one time point, calculating a running average of the magnitude value within a selected time window that moves along a selected time period of the measurement data;

then identifying the flow rate change event at each group of contiguous times at which the running average of the magnitude value exceeds a second threshold value; and assigning a signed indicator unit value at each time point corresponding to an identified flow rate change event, the sign of the signed indicator unit value corresponding to the polarity of change in gradient of the identified flow rate change event.

22. A computerized system for evaluating waterflood injection at a subsurface hydrocarbon reservoir into which one or more producing wells and one or more injecting wells have been drilled, comprising:

one or more processing units for executing program instructions;

a memory resource, for storing measurement data over time corresponding to flow rates at one or more producing wells and one or more injecting wells; and program memory, coupled to the one or more processing units, for storing a computer program including program instructions that, when executed by the one or more processing units, is capable of causing the computer system to perform a sequence of operations comprising:

receiving measurement data from the memory resource;

from the received measurement data, identifying a plurality of associations between one of the producing wells and one of the injecting wells, based on time correspondence of events at the one of the injecting well and events at the one of the production wells identified in the received measurement data; each of the identified associations having a measure of strength of association;

ordering the identified associations according to a rank of the strength of association;

applying one or more of the associations with the highest ranks to a capacitance-resistivity reservoir model;

evaluating the capacitance-resistivity reservoir model relative to the measurement data to derive a set of model parameters and an associated uncertainty statistic;

applying a next one or more of the associations, selected according to the ordering of the associations by rank, to the capacitance-resistivity reservoir model;

evaluating the capacitance-resistivity reservoir model, with the applied next one or more of the associations, relative to the measurement data, to derive a set of model parameters and an associated uncertainty statistic;

repeating the operations of applying a next one or more of the associations and evaluating the capacitance-resistivity reservoir model with the applied next one or more of the associations, until the uncertainty statistic reflects similarity of the model parameters from the most recent evaluating and the model parameters from a prior evaluating, to a selected statistical significance; and directing a change in fluid injection flow in one of the injecting wells based on analysis of the capacitance-resistivity reservoir model.

23. The system of claim 22, wherein the sequence of operations further comprises, after the repeated applying and evaluating operations, and responsive to the uncertainty statistic reflecting similarity to the selected statistical significance:

then evaluating a proposed injection at one or more of the injection wells using the capacitance-resistivity reservoir model and evaluated model parameters.

24. The system of claim 22, wherein the ordering operation comprises:

grouping the identified associations into a plurality of subsets according to correspondence of polarity of changes in measurement data between the injecting well and the producing well;

wherein a first instance of the applying operation applies a first subset of associations corresponding to the highest-ranked associations to the capacitance-resistivity reservoir model;

and wherein a second instance of the applying operation applies a second subset of associations corresponding to the next highest-ranked associations to the capacitance-resistivity reservoir model.

25. The system of claim 22, wherein the sequence of operations further comprising:

from the measurement data corresponding to flow rates at the one or more injecting wells, identifying injector events at which a change of flow rate occurred;

from the measurement data corresponding to flow rates at the one or more producing wells, detecting producer events at which a change of flow rate occurred;

identifying detected producer events that occur within a selected range of delay times from identified injector events; and from the identified detected producer events, deriving associations between one of the injecting wells and one of the producing wells.

26. The system of claim 25, wherein the operation of identifying detected producer events comprises, for each of the one or more producing wells:

calculating a gradient in the measurement data at each of a plurality of time points; and detecting time points at which the calculated gradient changes from one time point to another by greater than a first threshold value.

27. The system of claim 26, wherein the operation of calculating a gradient at a time point calculates a back gradient of the measurement data and a corresponding measure of fit over a selected number of time points including time points prior to the time point;

and wherein the detecting operation comprises, for each of the plurality of time points:

comparing the measure of fit at the time point with the measure of fit at a prior time point;

responsive to the measure of fit at the time point being degraded from the measure of fit at the prior time point by a selected margin, calculating a forward gradient in the measurement data at the time point over a selected number of time points later than the time point; and identifying a producer event at the time point responsive to the forward gradient differing from the back gradient by more than the first threshold value.

28. The system of claim 27, wherein the operation of detecting producer events further comprises:

calculating a magnitude value for the difference between the forward gradient and the back gradient at the time point;

after the operation of detecting time points at which the calculated gradient changes from one time point, calculating a running average of the magnitude value within a selected time window that moves along a selected time period of the measurement data;

then identifying a producer event at each group of contiguous times at which the running average of the magnitude value exceeds a second threshold value; and assigning a signed indicator unit value at each time point corresponding to an identified producer event, the sign of the signed indicator unit value corresponding to the polarity of change in gradient of the identified producer event.

29. The system of claim 25, wherein the operation of identifying injector events comprises:

displaying a time series of measurement data for a selected injecting well at a display of a computer system;

operating the computer system to identify one or more potential injector events in the time series;

receiving a user input selecting one of the potential injector events;

for the selected potential injector event, displaying a portion of the time series of measurement data for the selected injecting well in combination with a portion of the time series of measurement data for a selected producing well at the display, normalized in time and amplitude to align in time with one another; and after the displaying of the portion of the time series, receiving a user input confirming the selected potential injector event.

30. The system of claim 25, wherein the sequence of operations further comprises:

after the operation of identifying injector events, and before the operation of detecting one or more producer events, evaluating a capacitance-resistivity reservoir model relative to the measurement data to derive gain values for each injector-producer pair; and defining a subset of one or more injector-producer pairs having non-zero gain values;

wherein the operations of identifying detected producer events and deriving associations are performed over the defined subset of one or more injector-producer pairs.

31. A non-transitory computer-readable medium storing a computer program that, when executed on a computer system, causes the computer system to perform a sequence of operations for evaluating waterflood injection at a subsurface hydrocarbon reservoir into which one or more producing wells and one or more injecting wells have been drilled, the sequence of operations comprising:

accessing stored measurement data corresponding to flow rates at one or more producing wells and one or more injecting wells over time;

from the measurement data, identifying a plurality of associations between one of the producing wells and one of the injecting wells, based on time correspondence of events at the one of the injecting well and events at the one of the production wells identified in the received measurement data; each of the identified associations having a measure of strength of association;

ordering the identified associations according to a rank of the strength of association;

applying one or more of the associations with the highest ranks to a capacitance-resistivity reservoir model;

evaluating the capacitance-resistivity reservoir model relative to the measurement data to derive a set of model parameters and an associated uncertainty statistic;

applying a next one or more of the associations, selected according to the ordering of the associations by rank, to the capacitance-resistivity reservoir model;

evaluating the capacitance-resistivity reservoir model, with the applied next one or more of the associations, relative to the measurement data, to derive a set of model parameters and an associated uncertainty statistic;

repeating the operations of applying a next one or more of the associations and evaluating the capacitance-resistivity reservoir model with the applied next one or more of the associations, until the uncertainty statistic reflects similarity of the model parameters from the most recent evaluating and the model parameters from a prior evaluating, to a selected statistical significance; and directing a change in fluid injection flow in one of the injecting wells based on analysis of the capacitance-resistivity reservoir model.

32. The computer-readable medium of claim 31, wherein the sequence of operations further comprises, after the repeated applying and evaluating operations, and responsive to the uncertainty statistic reflecting similarity to the selected statistical significance:

then evaluating a proposed injection at one or more of the injection wells using the capacitance-resistivity reservoir model and evaluated model parameters.

33. The computer-readable medium of claim 31, wherein the ordering operation comprises:

grouping the identified associations into a plurality of subsets according to correspondence of polarity of changes in measurement data between the injecting well and the producing well;

wherein a first instance of the applying operation applies a first subset of associations corresponding to the highest-ranked associations to the capacitance-resistivity reservoir model;

and wherein a second instance of the applying operation applies a second subset of associations corresponding to the next highest-ranked associations to the capacitance-resistivity reservoir model.

34. The computer-readable medium of claim 31, wherein the sequence of operations further comprising:

from the measurement data corresponding to flow rates at the one or more injecting wells, identifying injector events at which a change of flow rate occurred;

from the measurement data corresponding to flow rates at the one or more producing wells, detecting producer events at which a change of flow rate occurred;

identifying detected producer events that occur within a selected range of delay times from identified injector events; and from the identified detected producer events, deriving associations between one of the injecting wells and one of the producing wells.

35. The computer-readable medium of claim 34, wherein the operation of identifying detected producer events comprises, for each of the one or more producing wells:

calculating a gradient in the measurement data at each of a plurality of time points; and detecting time points at which the calculated gradient changes from one time point to another by greater than a first threshold value.

36. The computer-readable medium of claim 35, wherein the operation of calculating a gradient at a time point calculates a back gradient of the measurement data and a corresponding measure of fit over a selected number of time points including time points prior to the time point;

and wherein the detecting operation comprises, for each of the plurality of time points:

comparing the measure of fit at the time point with the measure of fit at a prior time point;

responsive to the measure of fit at the time point being degraded from the measure of fit at the prior time point by a selected margin, calculating a forward gradient in the measurement data at the time point over a selected number of time points later than the time point; and identifying a producer event at the time point responsive to the forward gradient differing from the back gradient by more than the first threshold value.

37. The computer-readable medium of claim 36, wherein the operation of detecting producer events further comprises:

calculating a magnitude value for the difference between the forward gradient and the back gradient at the time point;

after the operation of detecting time points at which the calculated gradient changes from one time point, calculating a running average of the magnitude value within a selected time window that moves along a selected time period of the measurement data;

then identifying a producer event at each group of contiguous times at which the running average of the magnitude value exceeds a second threshold value; and assigning a signed indicator unit value at each time point corresponding to an identified producer event, the sign of the signed indicator unit value corresponding to the polarity of change in gradient of the identified producer event.

38. The computer-readable medium of claim 34, wherein the operation of identifying injector events comprises:

displaying a time series of measurement data for a selected injecting well at a display of a computer system;

operating the computer system to identify one or more potential injector events in the time series;

receiving a user input selecting one of the potential injector events;

for the selected potential injector event, displaying a portion of the time series of measurement data for the selected injecting well in combination with a portion of the time series of measurement data for a selected producing well at the display, normalized in time and amplitude to align in time with one another; and after the displaying of the portion of the time series, receiving a user input confirming the selected potential injector event.

39. The computer-readable medium of claim 34, wherein the sequence of operations further comprises:

after the operation of identifying injector events, and before the operation of detecting one or more producer events, evaluating a capacitance-resistivity reservoir model relative to the measurement data to derive gain values for each injector-producer pair; and defining a subset of one or more injector-producer pairs having non-zero gain values;

wherein the operations of identifying detected producer events and deriving associations are performed over the defined subset of one or more injector-producer pairs.

* * * * *